US007128413B2

(12) United States Patent
Yoshimura et al.

(10) Patent No.: US 7,128,413 B2
(45) Date of Patent: Oct. 31, 2006

(54) INK-JET RECORDING MEDIUM AND IMAGE FORMING METHOD

(75) Inventors: Kousaku Yoshimura, Shizuoka (JP); Masanobu Takashima, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 197 days.

(21) Appl. No.: 10/662,482

(22) Filed: Sep. 16, 2003

(65) Prior Publication Data

US 2004/0086666 A1 May 6, 2004

(30) Foreign Application Priority Data

Sep. 18, 2002 (JP) ..... 2002-272083

(51) Int. Cl.
*B41J 2/01* (2006.01)

(52) U.S. Cl. ..... 347/105; 347/101; 428/32.1

(58) Field of Classification Search ..... 347/105, 347/101, 100; 428/195, 32.1, 32.32, 32.33
See application file for complete search history.

(56) References Cited

U.S. PATENT DOCUMENTS 5,662,997 A * 9/1997 Onishi et al. ..... 347/105
5,955,185 A * 9/1999 Yoshino et al. ..... 347/105
6,838,135 B1 * 1/2005 Kasahara ..... 347/105
6,890,070 B1 * 5/2005 Ohya et al. ..... 347/105
2004/0090512 A1 * 5/2004 Yau et al. ..... 347/105

FOREIGN PATENT DOCUMENTS

| | | |
|---|---|---|
| EP | 0 743 193 A | 11/1996 |
| EP | 1 112 857 A | 7/2001 |
| JP | 2-31673 B | 7/1990 |
| JP | 9-156211 A | 6/1997 |
| JP | 10-324053 A | 12/1998 |

* cited by examiner

*Primary Examiner*—Manish S. Shah
(74) *Attorney, Agent, or Firm*—Sughrue Mion, PLLC

(57) ABSTRACT

To provide an ink-jet recording medium that can absorb inks satisfactorily and exhibits high print density, minimized bleeding with time and satisfactory light resistance, an ink-jet recording medium includes a support; and an ink receiving layer which is disposed on the support, contains at least fine polymer particles and has a porous structure. The ink receiving layer has a pore volume per unit thickness (A/B) of $2.0\times10^{-5}$ ml/cm$^2$/μm or more, where A is the pore volume ($\times10^{-5}$ ml/cm$^2$) in the ink receiving layer at a pore diameter equal to the average particle diameter of the fine polymer particles, which pore volume is determined based on a pore distribution curve obtained according to a nitrogen gas adsorption technique; and B is the dry thickness (μm) of the ink receiving layer.

20 Claims, 2 Drawing Sheets

INK-JET RECORDING MEDIUM AND IMAGE FORMING METHOD

BACKGROUND OF THE INVENTION

1. Field of the Invention

The present invention relates to an ink-jet recording medium which can satisfactorily absorb inks and exhibits high print density, minimized bleeding with time, and satisfactory light resistance, and to an image forming method using the ink-jet recording medium.

2. Description of the Related Art

A variety of information processing systems have been developed with rapid expansion of the information technology industry, and recording methods and recording apparatus suitable for the information processing systems have been developed and have been in actual use.

Among these recording methods, an ink-jet recording method is widely used in "home use" as well as in office use, since the method can record information on a variety of recording materials and can use hardware (apparatus) that is available at relatively low cost, is compact and is quiet.

"Photographic" high-quality records can be obtained with an increasing resolution of ink-jet printers, and a variety of ink-jet recording mediums for use in such applications have been developed.

Such ink-jet recording mediums must generally: (1) dry quickly (absorb inks at a high speed), (2) form ink dots having a proper and uniform diameter without bleeding, (3) form ink dots which are satisfactorily particulate, (4) form ink dots with high circularity, (5) form images with high color density, (6) form images with high chromaticness without dullness, (7) carry a printing area with good water resistance, light resistance, and ozone resistance, (8) have a high degree of whiteness, (9) be stored satisfactorily, without yellowing or coloring even during long-term storage and without bleeding of images even during long-term storage, i.e., with minimized bleeding with time, (10) be resistant to deformation and have good dimensional stability with sufficiently minimized curling, and (11) pass through an apparatus smoothly.

When these ink-jet recording mediums are used in photo (glossy) paper to obtain "photographic" high-quality records, they must further have satisfactory glossiness, surface smoothness, and printing-paper-like feeling similar to silver halide film photos, in addition to the above properties.

To satisfy the above requirements, a variety of recording media have been proposed. For example, a proposal to improve absorption, color development and resolution can be found in Japanese Patent Application Laid-Open (JP-A) No. 02-276670, which discloses a recording medium comprising a support and a porous layer which is disposed on the support and contains inorganic particles such as aluminium hydrates. Another proposal can be found in JP-A No. 04-101880 which discloses a recording medium comprising a support, and an ink-fixing layer which is disposed on the support and contains a transparent resin that is dissolved in or swells with a solvent in an ink. Still another proposal can be found in Japanese Patent Application Publications (JP-B) No. 02-18146 and No. 02-31673, each of which discloses a recording medium comprising a support, and an ink receiving layer which is disposed on the support and contains any one of thermoplastic resin particles, emulsions and latices.

Separately, JP-A No. 09-99634 proposes a recording medium having an ink receiving layer comprising a polymer complex of a basic polymer and a styrene/(meth)acrylic acid copolymer. JP-A No. 09-156211 proposes a recording medium comprising a transparent support and an ink receiving layer which is disposed on the support and contains fine crosslinked polymer particles having an average particle diameter of 200 nm or less and a water-soluble resin. This sheet-like medium has a transmittance of 80% or more. JP-A No. 10-324053 proposes a recording medium having a porous film prepared from an emulsion containing a nitrite ester of carboxycellulose, and a film-forming aid.

These conventional recording media have improved ink absorbency or exhibit improved resolution, density, transparency and glossiness of the resulting images. However, even these recording media have some problems when they are subjected to high-speed printing of high-quality images equivalent to silver halide film photos, which technology has been achieved with the rapid-pace advance of recording apparatus.

For example, the recording medium disclosed in JP-A No. 02-276670 has a porous layer which contains inorganic particles such as aluminium hydrates, is disposed on its surface and exhibits satisfactory image quality and glossiness. However, the surface of the recording medium is brittle and thereby is readily damaged during transportation in some transportation systems of printers. In addition, this recording medium comprises organic particles and an organic resin in combination, has thereby low transparency and causes a shadow of the medium projected on a screen when it is used in transmitting systems such as overhead projector (OHP) films.

The recording medium disclosed in JP-A No. 04-101880 has an ink-fixing layer comprising a resin that is dissolved in or swells with a solvent in an ink. This recording medium exhibits a low drying speed of an ink and remains sticky for some time after recording. In addition, its ink-receiving layer does not have sufficient water resistance and invites migration of a dye due to moisture. The insufficient water resistance of the ink-receiving layer further invites cracks in printed areas, specifically in solid-printed areas, when a pigment is used as the ink.

The recording media disclosed in JP-B No. 02-18146 and JP-B No. 02-31673 comprise a support, and an ink receiving layer which is disposed on the support and contains any one of thermoplastic resin particles, emulsions, and latices. The recording media can absorb an ink at a high speed, but their ink absorbing property utilizes only voids among thermoplastic resin particles. Accordingly, to absorb sufficient amounts of inks, it must have an increased thickness of the ink receiving layer, thus inviting decreased transparency and strength of the film.

In the recording medium disclosed in JP-A No. 09-99634 having an ink receiving layer comprising a binder and organic particles, the ink receiving layer is formed from a polymer complex obtained by dissolving the binder and organic particles in a solvent and mixing the solution. The resulting ink-receiving layer does not have sufficient pores or voids and is thereby not promising for absorbing inks at a high speed.

The recording medium disclosed in JP-A No. 09-156211 has a transparent support, and an ink-receiving layer which is disposed on the support and comprises fine crosslinked polymer particles having an average particle diameter of 200 nm or less and a water-soluble resin. This recording medium cannot have sufficient voids among the fine particles, since it uses a water-soluble resin as a binder. In addition, it cannot significantly have an increased absorption speed by action of such voids, since it uses a relatively large amount of the water-soluble resin in a ratio of the water-soluble resin to the fine polymer particles of 1:1 to 1:10.

The recording medium disclosed in JP-A No. 10-324053 has a porous film formed from a film-forming aid and an emulsion containing a carboxycellulose nitrite and has voids among the emulsion particles. However, the porous film layer cannot be significantly controlled in its pH, and when pH is low and the film layer is acidic, a dye in an ink after printing peculiarly aggregates and thereby may exhibit a color different from its inherent color.

Consequently, ink-jet recording mediums that are capable of satisfactorily absorbing inks, exhibit high print density, minimized bleeding with time, and satisfactory light resistance and can print high-quality images equivalent to silver halide film photos at a high speed have not yet been provided, and demands on such improvements have been made.

SUMMARY OF THE INVENTION

Accordingly, an object of the present invention is to provide an ink-jet recording medium which has an ink receiving layer having a porous structure optimized by fine polymer particles (latex), can satisfactorily absorb inks and exhibits high print density, minimized bleeding with time, and satisfactory light resistance, and to provide an image forming method using the ink-jet recording medium.

An ink-jet recording medium of the present invention includes an ink receiving layer having a porous structure formed from fine polymer particles (latex). The ink-jet recording medium satisfies at least one of the following requirements. In a first aspect, the ink receiving layer has a pore volume per unit thickness of $2.0\times10^{-5}$ ml/cm$^2$/μm or more. In a second aspect, the ratio of Y to X [(Y/X)×100] is 65% or more, wherein Y is the pore diameter (nm) at the maximum peak of the pore volumes in the ink receiving layer as determined based on a pore distribution curve by a nitrogen gas adsorption technique; and X is the average particle diameter (nm) of the fine polymer particles. In a third aspect, the pore diameter Y is 33 nm or more, wherein Y is the pore diameter corresponding to the maximum peak of the pore volume of secondary particles of the fine polymer particles in the ink receiving layer.

The ink-jet recording medium according to any one of the first, second, and third aspects can have the ink receiving layer having a porous structure with optimized pore distribution, can have an increased porosity, can absorb inks satisfactorily and can perform ink-jet recording with high print density, minimized bleeding with time, and satisfactory light resistance.

An image forming method of the present invention includes the step of applying an ink to the ink receiving layer of the ink-jet recording medium of the present invention to thereby form an image. The method can thereby print high-quality images equivalent to silver halide film photos at a high speed with satisfactory ink absorbency, high print density, minimized bleeding with time, and satisfactory light resistance.

Further objects, features, and advantages of the present invention will become apparent from the following description of the preferred embodiments with reference to the attached drawings.

DESCRIPTION OF THE PREFERRED EMBODIMENTS

Ink-jet Recording Mediums

The ink-jet recording medium of the present invention comprises a support, and an ink receiving layer which is disposed on the support, comprises at least fine polymer particles and has a porous structure and may further comprise additional layer(s) selected according to necessity. Such additional layers include, for example, a backing layer, a protecting layer, an intermediate layer, an undercoat layer, a cushioning layer, a charge control (antistatic) layer, a reflective layer, a color-adjusting layer, a layer for improving storage stability, an anti-adhesion layer, an anti-curl layer, and a smoothing layer. Each of these layers may have a single-layer structure or a multilayer structure.

According to the present invention, the ink receiving layer constituting the ink-jet recording medium has pores and thereby has a porous structure. The porous structure of the ink receiving layer is preferably constituted by secondary particles of the fine polymer particles for a higher porosity and a higher ink absorption.

The pore distribution curve in absorption of the ink-receiving layer can be measured, for example, according to a nitrogen gas adsorption technique and determined by calculation according to the Barrett-Joyner-Halenda (BJH) method.

Figure 1:
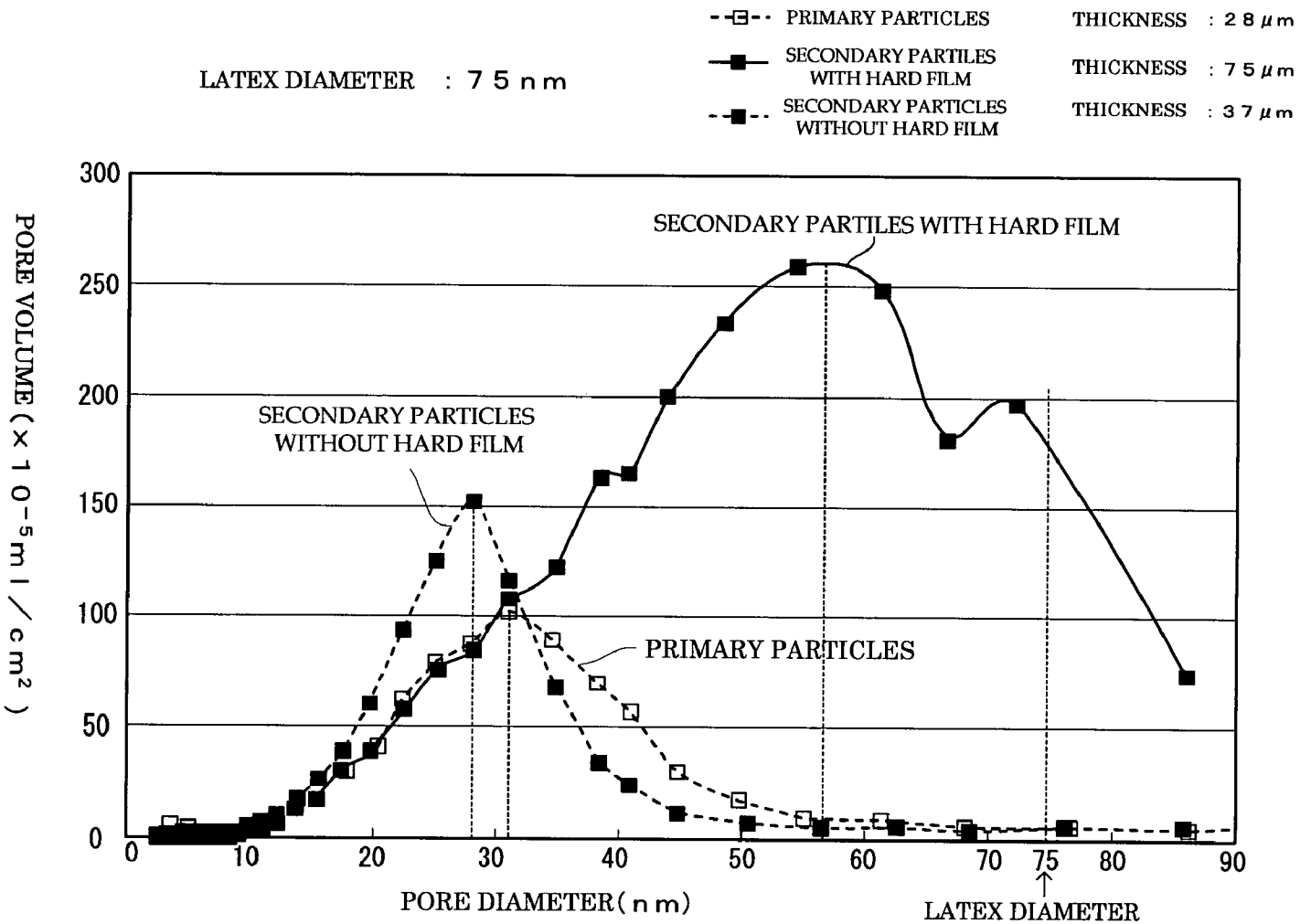
FIG. 1 is a graph of pore distribution curves in ink-jet recording mediums.
Figure 2:
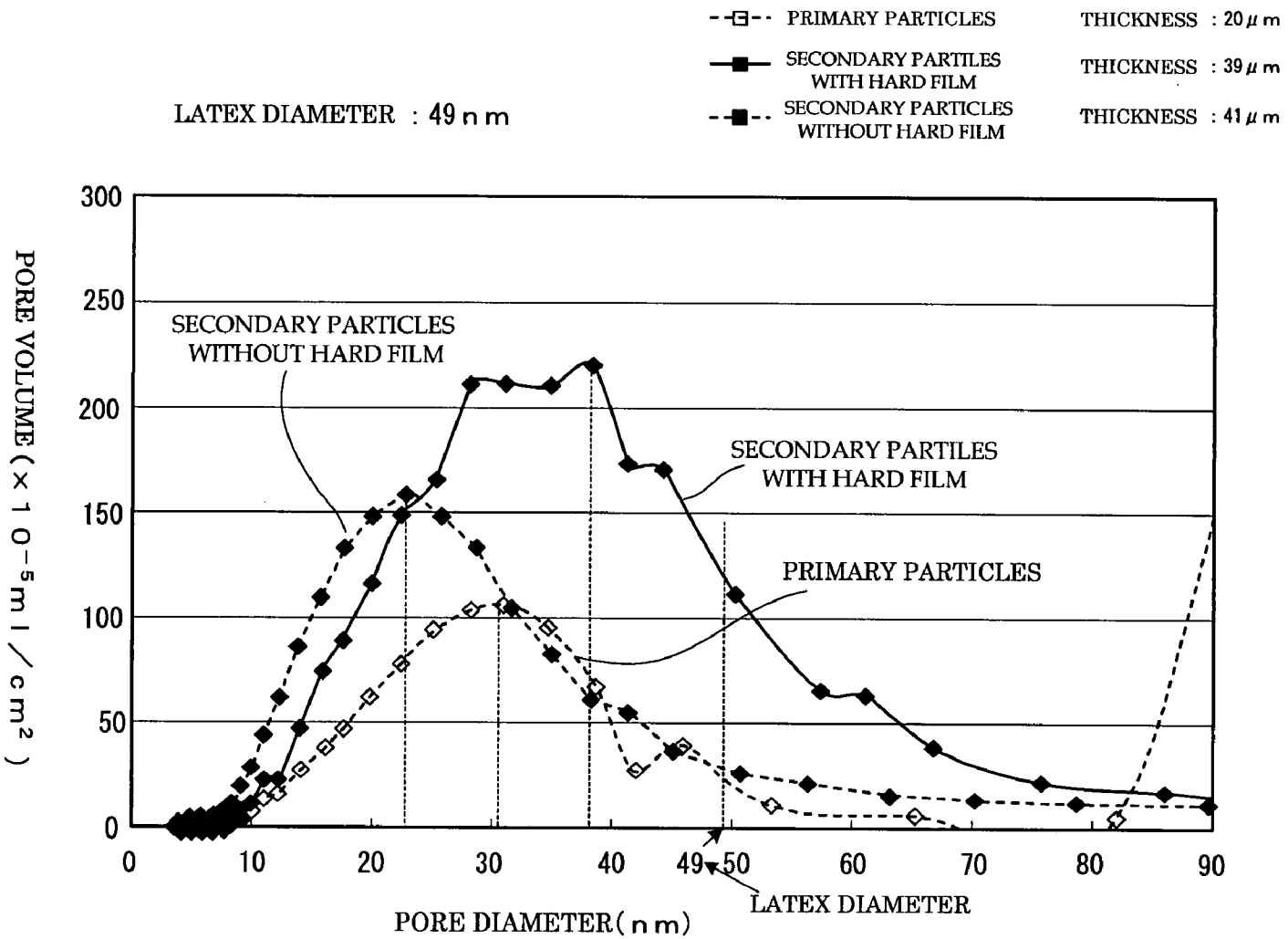
FIG. 2 is another graph of pore distribution curves in ink-jet recording mediums.

More specifically, FIG. 1 shows pore distribution curves in which the fine polymer particles have a primary particle diameter of 75 nm, and FIG. 2 shows pore distribution curves in which the fine polymer particles have a primary particle diameter of 49 nm. With reference to FIGS. 1 and 2, the pore distribution curve of an ink-jet recording medium having secondary particles of the fine polymer particles and having a hard film has a larger maximum peak in the pore volumes and a larger pore diameter corresponding thereto than the pore distribution curve of an ink-jet recording medium having such secondary particles but having no hard film, and the pore distribution curve of an ink-jet recording medium primary particles alone without secondary particles. The pore distribution curve of the ink receiving layer having a porous structure can also be optimized according to the results in examples mentioned later.

In the present invention, therefore, the pore volume per unit thickness (A/B) of the ink receiving layer is preferably $2.0\times10^{-5}$ ml/cm$^2$/μm or more, more preferably $3.0\times10^{-5}$ ml/cm$^2$/μm or more, and further preferably 3.0 to $5.0\times10^{-5}$ ml/cm$^2$/μm, wherein A is the pore volume ($\times10^{-5}$ ml/cm$^2$) in the ink receiving layer at a pore diameter equal to the average particle diameter of the fine polymer particles, the pore volume being determined based on a pore distribution curve obtained according to a nitrogen gas adsorption technique; and B is the dry thickness (μm) of the ink receiving layer.

If the pore volume per unit thickness of the ink receiving layer is less than $2.0\times10^{-5}$ ml/cm$^2$/μm, the ink receiving layer may have an insufficient porosity per unit thickness and may not absorb inks in sufficient amounts.

The pore volume A in the ink receiving layer at a pore diameter equal to the average particle diameter of the fine polymer particles varies depending on the dry thickness of the ink receiving layer and is, for example, preferably $50\times10^{-5}$ ml/cm$^2$ or more, more preferably $100\times10^{-5}$ ml/cm$^2$ or more, and further preferably $130\times10^{-5}$ ml/cm$^2$ or more.

The pore volume at a pore diameter equal to the particle diameter of the fine polymer particles in the ink receiving layer can be determined based on a pore distribution curve which is measured by a nitrogen gas adsorption technique and determined by calculation according to the BJH method.

The ratio of Y to X [(Y/X)×100] is preferably 65% or more, and more preferably 70% or more, wherein Y is the pore diameter (nm) at the maximum peak of the pore volumes in the ink receiving layer in the ink-jet recording medium, the pore diameter is determined based on a pore distribution curve obtained according to a nitrogen gas adsorption technique; and X is the average particle diameter (nm) of the fine polymer particles.

If the ratio [(Y/X)×100] is less than 65%, the medium may not absorb inks satisfactorily, thus inviting bleeding of images.

The dry thickness of the ink receiving layer is not specifically limited, can be appropriately set depending on an intended purpose and is preferably 10 to 100 μm, more preferably 15 to 70 μm, and further preferably 20 to 50 μm.

The pore diameter Y is preferably 33 nm or more, more preferably 35 nm or more, and further preferably 40 nm or more, wherein Y is the pore diameter corresponding to the maximum peak in the pore volumes of secondary particles of the fine polymer particles in the ink receiving layer and is determined based on a pore distribution curve obtained according to a nitrogen gas adsorption technique.

If the pore distribution curve of the ink receiving layer has a maximum peak at a pore volume Y lower than 33 nm, the resulting ink-jet recording medium may not absorb inks sufficiently.

The "maximum peak" as used herein means the maximum peak among peaks in the pore distribution curve of the ink receiving layer.

The maximum peak of the pore volume varies depending on, for example, the dry thickness of the ink receiving layer and is, for example, preferably 200 ml/cm$^2$ or more, and more preferably 220 ml/cm$^2$ or more.

The pore distribution curve preferably has a maximum peak of the pore volumes at a pore diameter within a range from 30 to 80 nm.

Ink Receiving Layer

The pores satisfying the aforementioned requirements can be formed in the ink receiving layer by appropriately controlling, for example, the type, particle diameter, and shape of the fine polymer particles constituting the ink receiving layer, and/or by controlling the type of the water-soluble resin used in combination with the fine polymer particles, the ratio of the water-soluble resin to the fine polymer particles, as well as the types, and amounts of the crosslinking agent, mordant, and other components constituting the ink receiving layer, the drying conditions for the formation of the ink receiving layer, and/or the thickness of the ink receiving layer.

The components of the ink receiving layer will be illustrated in detail below.

Fine Polymer Particles

The ink receiving layer comprises the fine polymer particles, thereby has a porous structure and can absorb inks more satisfactorily. The solid-basis content of the fine polymer particles in the ink receiving layer is preferably 50% by mass or more, and more preferably 60% by mass or more. Thus, the resulting ink-jet recording medium can have a satisfactory porous structure in the ink receiving layer and can thereby absorb inks further satisfactorily. The upper limit of the solid-basis content of the fine polymer particles in the ink receiving layer is not specifically limited and is generally about 90% by mass or less. The "solid-basis content" of the fine polymer particles in the ink receiving layer means the content of the fine polymer particles in the ink receiving layer determined by calculation based on the mass of the other components than water in a composition constituting the ink receiving layer.

The fine polymer particles (latex) can be used in the form of a dispersion of a variety of polymers in a hydrophilic medium. Specifically, aqueous dispersions of homo- or co-polymers of vinyl monomers, ester polymers, urethane polymers, amide polymers, epoxy polymers, modified products and copolymers of these polymers can be used. Among them, homo- or co-polymers of vinyl monomers, and urethane polymers are preferably used, of which homo- or co-polymers of vinyl monomers are typically preferred for better ink absorbency and coated film strength.

Such vinyl monomers include, for example, aromatic vinyl compounds, vinyl cyanides, vinyl esters of carboxylic acids, aliphatic conjugated dienes, alkyl esters of (meth) acrylic acid, alkyl aryl esters of (meth)acrylic acid, substituted alkyl esters of (meth)acrylic acid, alkyl (meth)acrylamides, substituted-alkyl (meth)acrylamides, and polymerizable oligomers.

Examples of the aromatic vinyl compounds are styrene, α-methylstyrene, p-hydroxystyrene, chloromethylstyrene, and vinyltoluene. Examples of the vinyl cyanides are (meth) acrylonitrile, and α-chloroacrylonitrile. Examples of the vinyl esters of carboxylic acids are vinyl acetate, vinyl benzoate, and vinyl formate. The aliphatic conjugated dienes include, but are not limited to, 1,3-butadiene, and isoprene. The alkyl esters of (meth)acrylic acid include, but are not limited to, methyl (meth)acrylate, ethyl (meth)acrylate, n-butyl (meth)acrylate, iso-butyl (meth)acrylate, and 2-ethylhexyl (meth)acrylate. The alkyl aryl esters of (meth) acrylic acid include, but are not limited to, benzyl (meth) acrylate. The substituted alkyl esters of (meth)acrylic acid include, but are not limited to, glycidyl (meth)acrylate, 2-hydroxyethyl (meth)acrylate, dimethylaminoethyl (meth) acrylate, and dimethylaminopropyl (meth)acrylate. The alkyl-(meth)acrylamides include, but are not limited to, (meth)acrylamide, dimethyl(meth)acrylamide, N-isopropyl (meth)acrylamide, n-butyl(meth)acrylamide, tert-butyl (meth)acrylamide, and tert-octyl(meth)acrylamide. The substituted alkyl (meth)acrylamides include, but are not limited to, dimethylaminoethyl(meth)acrylamide, and dimethylaminopropyl(meth)acrylamide. The polymerizable oligomers include, but are not limited to, methyl methacrylate oligomers each having a methacryloyl group at one end, styrene oligomers each having a methacryloyl group at one end, and ethylene glycol oligomers each having a methacryloyl group at one end.

The fine polymer particles are preferably crosslinked by action of a polyfunctional monomer. The polyfunctional monomer includes, but is not limited to, aromatic divinyl compounds, esters or amides of diethylene carboxylic acids, and other divinyl compounds.

The aromatic divinyl compounds include, but are not limited to, divinylbenzenes, divinylnaphthalenes, and derivatives of these compounds. The esters or amides of diethylene carboxylic acids include, but are not limited to, ethylene glycol di(meth)acrylate, trimethylolpropane tri (meth)acrylate, and dipentaerythritol hexa(meth)acrylate. The other divinyl compounds include, but are not limited to, divinyl sulfide compounds, and divinyl sulfone compounds.

The proportion of the polyfunctional monomer introduced in the fine polymer particles is preferably 2% by mole or more, and more preferably 5% by mole or more. Thus, the deformation of the particles during coating, drying, and other procedures can be prevented, and the resulting ink receiving layer can have larger voids or pores.

These fine polymer particles are generally prepared by emulsion polymerization. Conventional surfactants, polymerization initiators, and other agents can be used in the emulsion polymerization. Detailed descriptions of methods for producing the fine polymer particles can be found, for example, in U.S. Pat. No. 2,852,368, No. 2,853,457, No. 3,411,911, No. 3,411,912, and No. 4,197,127; Belgian Patents No. 688,882, No. 691,360, and No. 712,823; JP-B No. 45-5331; JP-A No. 60-18540, JP-A No. 51-130217, JP-A No. 58-137831, and JP-A No. 55-50240.

The average particle diameter of the fine polymer particles is preferably 10 to 100 nm, and more preferably 15 to 80 nm. The glass transition temperature Tg of the fine polymer particles is not specifically limited and can be appropriately set depending on an intended purpose. To prevent deformation of particles during coating and/or drying procedure, it is preferred that the fine polymer particles have a high glass transition temperature and are rigid. Such fine polymer particles can be appropriately selected in consideration of the type of a binder used, the ratio to the binder, and ink absorbency of the resulting medium, and other conditions.

The fine polymer particles preferably form secondary particles to thereby further increase the porosity of the ink receiving layer.

The ink receiving layer in the ink-jet recording medium of the present invention may further comprise a water-soluble resin, a crosslinking agent for crosslinking the water-soluble resin, a mordant, and other components according to necessity, in addition to the fine polymer particles.

Water-soluble Resins

Such water-soluble resins for use herein are not specifically limited, can be appropriately selected depending on an intended purpose and include, for example, poly(vinyl alcohol) resins, cellulosic resins, resins having an ether bond, resins having a carbamoyl group, resins having a carboxyl group, and gelatin substances.

The poly(vinyl alcohol) resins include, but are not limited to, poly(vinyl alcohol)s (PVAs), partially saponified poly(vinyl alcohol)s, acetoacetyl-modified poly(vinyl alcohol)s, cation-modified poly(vinyl alcohol)s, anion-modified poly(vinyl alcohol)s, silanol-modified poly(vinyl alcohol)s, and poly(vinyl acetal)s. The cellulosic resins and derivatives thereof include, but are not limited to, methylcellulose (MC), ethyl cellulose (EC), hydroxyethyl cellulose (HEC), carboxymethylcellulose (CMC), hydroxypropyl cellulose (HPC), hydroxyethylmethylcellulose, and hydroxypropylmethylcellulose. The resins having an ether bond include, but are not limited to, poly(ethylene oxide)s (PEOs), poly(propylene oxide)s (PPOs), polyethylene glycols (PEGs), and poly(vinyl ether)s (PVEs). The resins having a carbamoyl group include, but are not limited to, polyacrylamides (PAAMs), polyvinylpyrrolidones (PVPs), and poly(acrylic hydrazide)s. The other resins include, but are not limited to, chitins, chitosans, starches, as well as poly(acrylic acid salt)s having a carboxyl group as a leaving group, maleic acid resins, alginic acid salts, and gelatin substances.

Each of these resins can be used alone or in combination.

Among them, poly(vinyl alcohol) resins are preferred, of which partially saponified poly(vinyl alcohol)s having a degree of saponification of 65% to 90% are typically preferred. The resulting fine polymer particles can further efficiently form secondary particles.

Examples of the poly(vinyl alcohol) resins can be found in JP-B No. 04-52786, JP-B No. 05-67432, JP-B No. 07-29479, Japanese Patent (JP-B) No. 2537827, JP-B No. 07-57553, JP-B No. 2502998, JP-B No. 3053231, JP-A No. 63-176173, JP-B No. 2604367, JP-A No. 07-276787, JP-A No. 09-207425, JP-A No. 11-58941, JP-A No. 2000-135858, JP-A No. 2001-205924, JP-A No. 2001-287444, JP-A No. 62-278080, JP-A No. 09-39373, JP-B No. 2750433, JP-A No. 2000-158801, JP-A No. 2001-213045, JP-A No. 2001-328345, JP-A No. 08-324105, and JP-A No. 11-348417.

Examples of the water-soluble resins other than the poly(vinyl alcohol) resins can also be found as compounds described in [0011] through [0014] in JP-A No. 11-165461.

The content of the water-soluble resin is preferably 4% by mass to 25% by mass, and more preferably 5% by mass to 16% by mass, of the total solids in the ink receiving layer.

The porous ink receiving layer thus prepared can rapidly absorb an ink and can form satisfactorily circular dots without ink bleeding in ink-jet recording.

Mass Ratio of Fine Polymer Particles to Water-soluble Resin

The mass ratio [PB ratio (X:Y)] of the fine polymer particles (X) to the water-soluble resin (Y) significantly affects the film structure and film strength of the ink receiving layer. Specifically, with an increasing mass ratio [PB ratio], the porosity, pore volume, and surface area per unit mass may increase, but the density and strength may decrease.

If the mass ratio [PB ratio (X:Y)] is excessively high, the film strength may decrease and/or cracking may occur during drying. If it is excessively low, the voids or pores may be readily filled with the resin to decrease the porosity, and the resulting medium may not satisfactorily absorb inks. To avoid these problems, the mass ratio [PB ratio (X:Y)] in the ink receiving layer is preferably from 4:1 to 20:1, and more preferably from 6:1 to 20:1.

The ink-jet recording medium may receive stress when it passes through a transportation system in an ink-jet printer, and the ink receiving layer must have a sufficient film strength to resist the stress. In addition, when the material is cut to a sheet to thereby yield the ink-jet recording medium, the ink receiving layer may crack or peel off. To avoid these problems, the ink receiving layer should preferably have a sufficient film strength.

Crosslinking Agents

The crosslinking agent is not specifically limited, as long as it can crosslink the water-soluble resin. Among such crosslinking agents, boron compounds are preferred for crosslinking poly(vinyl alcohol)s. Such boron compounds include, but are not limited to, borax; boric acids; borates such as orthoborates, $InBO_3$, $ScBO_3$, $YBO_3$, $LaBO_3$, $Mg_3(BO_3)_2$ and $Co_3(BO_3)_2$; diborates such as $Mg_2B_2O_5$, and $Co_2B_2O_5$; metaborates such as $LiBO_2$, $Ca(BO_2)_2$, $NaBO_2$, and $KBO_2$; tetraborates such as $Na_2B_4O_7.10H_2O$; pentaborates such as $KB_5O_8.4H_2O$, $Ca_2B_6O_{11}.7H_2O$, and $CsB_5O_5$. Among them, borax, boric acids, and borates are preferred for their capability of rapidly inducing crosslinking reactions, of which boric acids are typically preferred.

In addition to the boron compounds, the crosslinking agents for the water-soluble resin also include formaldehyde, glyoxal, glutaraldehyde, and other aldehyde compounds; diacetyl, cyclopentanedione, and other ketone compounds; bis(2-chlroethylurea)-2-hydroxy-4,6-dichloro-1,3,5-triazine, sodium 2,4-dichloro-6-S-triazine, and other active halogen compounds; divinylsulfonic acid, 1,3-divinylsulfonyl-2-propanol, N,N'-ethylenebis(vinylsulfonylacetamide), 1,3,5-triacryloyl-hexahydro-S-triazine, and other active vinyl compounds; dimethylol urea, methylol dimethyl hydantoin, and other N-methylol compounds; methylol melamine, alkylated methylol melamine, and other melamine resins; epoxy resins; 1,6-hexamethylene diisocyanate, and other isocyanate compounds; aziridine compounds disclosed in U.S. Pat. No. 3,017,280, and No. 2,983,611; carboxyimide compounds disclosed in U.S. Pat. No. 3,100,704; glycerol triglycidyl ether, and other epoxy compounds; 1,6-hexamethylene-N,N'-bisethylene urea, and other ethylene imino compounds; mucochloric acid, mucophenoxychloric acid, and other halogenated carboxyaldehyde compounds; 2,3-dihydroxydioxane, and other dioxane compounds; titanium lactate, aluminium sulfate, chromium alum, potassium alum, zirconium oxyacetate, chromium acetate, and other metal-containing compounds; tetraethylenepentamine, and other polyamine compounds; adipic acid dihydrazide, and other hydrazide compounds; low-molecular-weight compounds or polymeric compounds having two or more oxazoline groups.

Each of these crosslinking agents can be used alone or in combination.

The water-soluble resin is preferably crosslinked and cured by adding the crosslinking agent to a coating composition comprising the fine polymer particles, the water-soluble resin, and other components (hereinafter referred to as "coating composition A") and/or to a basic solution pH 8 or higher (hereinafter referred to as "coating composition B"), and applying the coating composition B to a coated layer of the coating composition A (1) at the same time when the coating composition A is applied to thereby form a coated layer, or (2) at any time during drying procedure of the coated layer formed by the application of the coating composition A and before the coated layer exhibits a falling rate of drying.

By taking a boron compound as an example, the crosslinking agent is preferably applied in the following manner. When the coating composition (coating composition A) containing the fine polymer particles and the water-soluble resin including a poly(vinyl alcohol) is applied to form a coated layer, and the coated layer is crosslinked and cured to form the ink receiving layer, the coated layer is crosslinked and cured by applying the basic solution pH 8 or higher (coating composition B) to the coated layer (1) at the same time when the coating composition A is applied to thereby form the coated layer, or (2) at any time during drying procedure of the coated layer formed by the application of the coating composition A and before the coated layer exhibits a falling rate of drying. The boron compound serving as the crosslinking agent can be added to at least one of the coating composition A and the coating composition B and can be added to both.

The amount of the crosslinking agent is preferably 1% by mass to 50% by mass and more preferably 5% by mass to 40% by mass relative to the water-soluble resin.

Mordants

As the mordants for use herein, organic mordants such as cationic polymers (cationic mordants), or inorganic mordants are preferred. The mordant in the ink receiving layer interacts with a liquid ink comprising an anionic dye as the ink and thus stabilizes the ink to thereby improve the water resistance or to minimize bleeding with time. Each of the organic mordants and inorganic mordants can be used alone or in combination, respectively. For example, an organic mordant and an inorganic mordant can be used in combination.

The mordant can be added to the coating composition A containing the fine polymer particles and the water-soluble resin. If there is the risk of coagulation between the mordant and the fine polymer particles, the mordant can be added to the coating composition B.

As the cationic mordants, polymeric mordants each having a primary, secondary, or tertiary amino group or a quaternary ammonium salt group as a cationic group are preferably used. Cationic non-polymeric mordants can also be used. These mordants should preferably have a weight-average molecular weight of 500 to 100000 for better ink absorbency of the ink receiving layer.

Preferred examples of the polymeric mordants are homopolymers of monomers (mordant monomers) each having a primary, secondary, or tertiary amino group, a salt thereof, or a quaternary ammonium salt group, and copolymers or polycondensates of these mordant monomers with another monomer (hereinafter referred to as "non-mordant monomer"). These polymeric mordants can be used in any form of a water-soluble polymer or water-dispersible latex particles.

The monomers (mordant monomers) include, but are not limited to, trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzyl-N-p-vinylbenzylammonium chloride, and N,N-dimethyl-N-phenyl-N-p-vinylbenzylammonium chloride; trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzylammonium acetate, N,N,N-triethyl-N-2-(4-vinylphenyl)ethylammonium chloride, N,N,N-triethyl-N-2-(3-vinylphenyl)ethylammonium chloride, N,N-diethyl-N-methyl-N-2-(4-vinylphenyl)ethylammonium chloride, and N,N-diethyl-N-methyl-N-2-(4-vinylphenyl)ethylammonium acetate; quaternary compounds of methyl chlorides, ethyl chlorides, methyl bromides, ethyl bromides, methyl iodides, or ethyl iodides of N,N-dimethylaminoethyl (meth)acrylate, N,N-diethylaminoethyl (meth)acrylate, N,N-dimethylaminopropyl (meth)acrylate, N,N-diethylaminopropyl (meth)acrylate, N,N-dimethylaminoethyl (meth)acrylamide, N,N-diethylaminoethyl (meth)acrylamide, N,N-dimethylaminopropyl (meth)acrylamide, and N,N-diethylaminopropyl (meth)acrylamide, and sulfonates, alkyl sulfonates, acetates, alkyl-carboxylates derived from these quaternary compounds by replacing their anions.

Concrete examples of these monomers are monomethyldiallylammonium chloride, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylarnino)propylammonium chloride, triethyl-3-(methacryloylamino)propylammonium chloride, trimethyl-3-(acryloylamino)propylammonium chloride, and triethyl-3-(acryloylamino)propylammonium chloride; N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino)propylammonium chloride, trimethyl-2-(methacryloyloxy)ethylammonium bromide, trimethyl-3-(acryloylamino)propylammonium bromide, trimethyl-2-(methacryloyloxy)ethylammonium sulfonate, and trimethyl-3-(acryloylamino)propylammonium acetate.

The copolymerizable monomers include, but are not limited to, N-vinylimidazole, and N-vinyl-2-methylimidazole.

In addition, allylamine, diallylamine, salts and derivatives thereof can also be used. Such compounds include, but are not limited to, allylamine, allylamine hydrochloride, allylamine acetate, allylamine sulfate, diallylamine, diallylamine hydrochloride, diallylamine acetate, diallylamine sulfate, diallylmethylamine or salts thereof such as hydrochloride, acetate, and sulfate, as well as diallylamine dimethylammonium salts. The counter anions of the salts just mentioned above include, for example, chloride, acetic acid ion, and sulfuric acid ion. These allylamine, diallylamine, and derivatives thereof are not satisfactorily polymerized in the form of an amine. Therefore, these compounds are generally subjected to polymerization in the form of a salt and are desalinated according to necessity.

It is also acceptable that polymerization is performed using N-vinylacetamide, N-vinylformamide, or another unit, and the resulting polymer is hydrolyzed to have a vinylamine unit. The hydrolyzed polymer having a vinylamine unit can also be converted into a salt.

The "non-mordant monomer" means and includes monomers that do not contain a basic or cationic moiety such as primary, secondary, or tertiary amino group, a salt thereof, or a quaternary ammonium salt group and exhibit no or substantially little interaction with a dye in an ink-jet ink.

Examples of the non-mordant monomer are alkyl (meth) acrylates; cyclohexyl (meth)acrylate, and other cycloalkyl (meth)acrylates; phenyl (meth)acrylate, and other aryl (meth)acrylates; benzyl (meth)acrylate, and other aralkyl (meth)acrylates; styrene, vinyltoluene, α-methylstyrene, and other aromatic vinyl compounds; vinyl acetate, vinyl propionate, vinyl versatate, and other vinyl esters; allyl acetate, and other allyl esters; vinylidene chloride, vinyl chloride, and other halogen-containing monomers; (meth) acrylonitrile, and other vinyl cyanides; ethylene, propylene, and other olefins.

As the alkyl (meth)acrylates, those each having 1 to 18 carbon atoms in the alkyl moiety are preferred. Such alkyl (meth)acrylates include, but are not limited to, methyl (meth)acrylate, ethyl (meth)acrylate, propyl (meth)acrylate, isopropyl (meth)acrylate, n-butyl (meth)acrylate, isobutyl (meth)acrylate, t-butyl (meth)acrylate, hexyl (meth)acrylate, octyl (meth)acrylate, 2-ethylhexyl (meth)acrylate, lauryl (meth)acrylate, and stearyl (meth)acrylate.

Among them, methyl acrylate, ethyl acrylate, methyl methacrylate, ethyl methacrylate, and hydroxyethyl methacrylate are preferred.

Each of these non-mordant monomers can be used alone or in combination.

Preferred examples of the polymeric mordants also include poly(diallyldimethylammonium chloride)s, poly (methacryloyloxyethyl-β-hydroxyethyldimethylammonium chloride)s, poly(ethylene imine)s, polyallylamines and derivatives thereof, polyamide-polyamine resins, cationized starch, dicyandiamide formaldehyde condensates, dimethyl-2-hydroxypropylammonium salt polymers, polyamidines, polyvinylamines, dicyanamide-formaldehyde polycondensates, and other dicyan cationic resins, dicyanamide-diethylenetriamine polycondensates, and other polyamine cationic resins, epichlorohydrin-dimethylamine addition polymers, dimethyldiallylammonium chloride-$SO_2$ copolymers, diallylamine salt-$SO_2$ copolymers, (meth)acrylate-containing polymers each having a quaternary ammonium salt group substituted alkyl group in their ester moiety, and styryl polymers, and styryl polymers each having a quaternary ammonium salt group substituted alkyl group.

Specific examples of the polymeric mordants can be found in JP-A No. 48-28325, JP-A No. 54-74430, JP-A No. 54-124726, JP-A No. 55-22766, JP-A No. 55-142339, JP-A No. 60-23850, JP-A No. 60-23851, JP-A No. 60-23852, JP-A No. 60-23853, JP-A No. 60-57836, JP-A No. 60-60643, JP-A No. 60-118834, JP-A No. 60-122940, JP-A No. 60-122941, JP-A No. 60-122942, JP-A No. 60-235134, and JP-A No. 01-161236; U.S. Pat. No. 2,484,430, No. 2,548,564, No. 3,148,061, No. 3,309,690, No. 4,115,124, No. 4,124,386, No. 4,193,800, No. 4,273,853, No. 4,282,305, and No. 4,450,224; JP-A No. 01-161236, JP-A No. 10-81064, JP-A No. 10-119423, JP-A No. 10-157277, JP-A No. 10-217601, JP-A No. 11-348409, JP-A No. 2001-138621, JP-A No. 2000-43401, JP-A No. 2000-211235, JP-A No. 2000-309157, JP-A No. 2001-96897, JP-A No. 2001-138627, JP-A No. 11-91242, JP-A No. 08-2087, JP-A No. 08-2090, JP-A No. 08-2091, JP-A No. 08-2093, JP-A No. 08-174992, JP-A No. 11-192777, JP-A No. 2001-301314, JP-B No. 05-35162, JP-B No. 05-35163, JP-B No. 05-35164, JP-B No. 05-88846, JP-A No. 07-118333, JP-A No. 2000-344990, Japanese Patents JP-B) No. 2648847, and No. 2661677. Among such compounds, polyallylamines and derivatives thereof are typically preferred.

To prevent bleeding with time, polyallylamines and derivatives thereof each having a weight-average molecular weight of 100000 or less are preferred as the organic mordants.

Conventional or known allylamine polymers and derivatives thereof can be used as the polyallylamines and derivatives thereof. Such derivatives include, for example, salts of polyallylamine with acids; derivatives as a result of a polymeric reaction of polyallylamines, and copolymers of allylamine with another copolymerizable monomer. Examples of the acids just mentioned above are hydrochloric acid, sulfuric acid, phosphoric acid, nitric acid, and other inorganic acid; methanesulfonic acid, toluenesulfonic acid, acetic acid, propionic acid, cinnamic acid, (meth)acrylic acid, and other organic acids; combinations of these acids. The salts also include partial salts of polyallylamine. Examples of the copolymerizable monomers are (meth) acrylates, styrenes, (meth)acrylamides, acrylonitrile, and vinyl esters.

Examples of the polyallylamines and derivatives thereof can be found, for example, in JP-B No. 62-31722, JP-B No. 02-14364, JP-B No. 6343402, JP-B No. 6343403, JP-B No. 6345721, JP-B No. 63-29881, JP-B No. 01-26362, JP-B No. 02-56365, JP-B No. 02-57084, JP-B No. 04-41686, JP-B No. 06-2780, JP-B No. 0645649, JP-B No. 06-15592, JP-B No. 04-68622, Japanese Patent GP-B) No. 3199227, JP-B No. 3008369, JP-A No. 10-330427, JP-A No. 11-21321, JP-A No. 2000-281728, JP-A No. 2001-106736, JP-A No. 62-256801, JP-A No. 07-173286, JP-A No. 07-213897, JP-A No. 09-235318, JP-A No. 09-302026, JP-A No. 11-21321, International Publication No. WO99/21901, International Publication No. WO99/19372, JP-A No. 05-140213, and JP-A No. 11-506488.

Inorganic mordants such as polyvalent water-soluble metallic salts and hydrophobic metallic salt compounds can also be used as the mordant.

Such inorganic mordants include, but are not limited to, salts and complexes of metals selected from magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten, and bismuth.

Examples of the inorganic mordants are calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, copper(II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, nickel amidosulfate tetrahydrate, aluminum sulfate, aluminum alum, basic poly(aluminum hydroxide)s, aluminum sulfite, aluminum thiosulfate, poly(aluminum chloride)s, aluminum nitrate nonahydrate, aluminum chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetrairopropyl titanate, titanium acetylacetonate, titanium lactate, zirconium acetilacetonate, zirconyl acetate, zirconyl sulfate, ammonium zirconium carbonate, zirconyl stearate, zirconyl octanoate, zirconyl nitrate, zirconium oxychloride, zirconium hydroxychloride, chromium acetate, chromium sulfate, magnesium sulfate, magnesium chloride hexahydrate, magnesium citrate nonahydrate, sodium phosphotungstate, tungsten sodium citrate, dodecatungstophosphate n-hydrate, dodecatungstosilicate hexacosahydrate, molybdenum chloride, dodecamolybdophosphate n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octanoate, praseodymium nitrate, neodymium nitrate, samarium nitrate, europium nitrate, gadolinium nitrate, dysprosium nitrate, erbium nitrate, ytterbium nitrate, hafnium chloride, and bismuth nitrate.

Among these inorganic mordants, aluminum-containing compounds, titanium-containing compounds, zirconium-containing compounds, and compounds (salts and complexes) of metals of Group 3B of the Periodic Table of Elements are preferred.

The amount of the mordant in the ink receiving layer is preferably 0.01 to 5 g/m$^2$, and more preferably 0.1 to 3 g/m$^2$.

Other Components

As the other components, the ink receiving layer may further comprise known or conventional additives according to necessity. Such additives include, but are not limited to, acids, ultraviolet absorbing agents, antioxidants, fluorescent brightening agents, monomers, polymerization initiators, polymerization inhibitors, bleeding inhibitors, antiseptics, viscosity stabilizing agents, antifoaming agents, surfactants, antistatic agents, matting agents, curling inhibitors, and water-resistance improvers.

The ink receiving layer may comprise an acid. The surface pH of the ink receiving layer is adjusted to 3 to 8, and preferably 5 to 7.5 by adding such an acid. Thus, white background portions can have improved resistance to yellowing. The surface pH may be measured according to the method A (coating method) as specified by Japan Technical Association of the Pulp and Paper Industry (Japan TAPPI). For example, the surface pH can be measured by using a paper surface pH measuring set "Type MPC" available from Kyoritsu Chemical-Check lab., Corp. (Japan) corresponding to the method A.

Examples of the acid include formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, glutaric acid, gluconic acid, lactic acid, aspartic acid, glutamic acid, salicylic acid, metallic salts (salts of, for example, Zn, Al, Ca, or Mg) of salicylic acid, methanesulfonic acid, itaconic acid, benzenesulfonic acid, toluenesulfonic acid, trifluoromethanesulfonic acid, styrenesulfonic acid, trifluoroacetic acid, barbituric acid, acrylic acid, methacrylic acid, cinnamic acid, 4-hydroxybenzoic acid, aminobenzoic acid, naphthalenedisulfonic acid, hydroxybenzenesulfonic acid, toluenesulfinic acid, benzenesulfinic acid, sulfanilic acid, sulfamic acid, α-resorcilic acid, β-resorcilic acid, γ-resorcilic acid, gallic acid, fluoroglycine, sulfosalicylic acid, ascorbic acid, erythorbic acid, bisphenolic acid, hydrochloric acid, nitric acid, sulfuric acid, phosphoric acid, polyphosphoric acid, boric acid, and boronic acid. The amount of these acids can be set so as to allow the surface pH of the ink receiving layer to fall within the rage of 3 to 8.

The acid can also be used in the form of a metallic salt or an amine salt. Such metallic salts include, for example, salts of sodium, potassium, calcium, cesium, zinc, copper, iron, aluminum, zirconium, lanthanum, yttrium, magnesium, strontium, and cerium. The amine salts include, for example, salts of ammonia, triethylamine, tributylamine, piperazine, 2-methylpiperazine, and polyallylamine.

The ink receiving layer preferably comprises any of storage stability improvers such as ultraviolet absorbing agents, antioxidants, and bleeding inhibitors.

Such ultraviolet absorbing agents, antioxidants, and bleeding inhibitors include, but are not limited to, alkylated phenol compounds inclusive of hindered phenol compounds, alkylthiomethylphenol compounds, hydroquinone compounds, alkylated hydroquinone compounds, tocopherol compounds, thiodiphenyl ether compounds, compounds each having two or more thioether bonds, bisphenol compounds, O-, N-, and S-benzyl compounds, hydroxybenzyl compounds, triazine compounds, phosphonate compounds, acylaminophenol compounds, ester compounds, amide compounds, ascorbic acid, amine antioxidants, 2-(2-hydroxyphenyl)benzotriazole compounds, 2-hydroxybenzophenone compounds, acrylates, water-soluble or hydrophobic metallic salts, organometallic compounds, metallic complexes, hindered amine compounds inclusive of 2,2,6,6-tetramethylpiperidine-N-oxide (TEMPO) compounds, 2-(2-hydroxyphenyl)-1,3,5-triazine compounds, metal deactivators, phosphite compounds, phosphonite compounds, hydroxyamine compounds, nitron compounds, peroxide scavengers, polyamide stabilizers, polyether compounds, basic auxiliary stabilizers, nucleating agents, benzofuranone compounds, indolinone compounds, phosphine compounds, polyamine compounds, thiourea compounds, urea compounds, hydrazide compounds, amidine compounds, glycoconjugates or saccharide compounds, hydroxybenzoic acid compounds, dihydroxybenzoic acid compounds, and trihydroxybenzoic acid compounds.

Among them, preferred are alkylated phenol compounds, compounds each having two or more thioether compounds, bisphenol compounds, ascorbic acid, amine antioxidants, water-soluble or hydrophobic metallic salts, organometallic compounds, metallic complexes, hindered amine compounds, hydroxyamine compounds, polyamine compounds, thiourea compounds, hydrazide compounds, hydroxybenzoic acid compounds, dihydroxybenzoic acid compounds, and trihydroxybenzoic acid compounds.

Examples of such compounds can be found, for example, in Japanese Patent Application Laid-Open (JP-A) No. 2002-307822, JP-A No. 10-182621, JP-A No. 2001-260519, JP-B No. 04-34953, JP-B No. 04-34513, JP-A No. 11-170686, JP-B No. 04-34512, EP No. 1138509, JP-A No. 60-67190, JP-A No. 7-276808, JP-A No. 2001-94829, JP-A No. 47-10537, JP-A No. 58-111942, JP-A No. 58-212844, JP-A No. 59-19945, JP-A No. 5946646, JP-A No. 59-109055, JP-A No. 63-53544, JP-B No. 36-10466, JP-B No. 42-26187, JP-B No. 48-30492, JP-B No. 48-31255, JP-B No. 4841572, JP-B No. 48-54965, JP-B No. 50-10726, U.S. Pat. No. 2,719,086, U.S. Pat. No. 3,707,375, U.S. Pat. No. 3,754,919, and U.S. Pat. No. 4,220,711, JP-B No. 454699, JP-B No. 54-5324, EP-A No. 223739, EP-A No. 309401, EP-A No. 309402, EP-A No. 310551, EP-A No. 310552, EP-A No. 459416, German Patent Application Laid-Open No. 3435443, JP-A No. 54-48535, JP-A No. 60-107384, JP-A No. 60-107383, JP-A No. 60-125470, JP-A No. 60-125471, JP-A No. 60-125472, JP-A No. 60-287485, JP-A No. 60-287486, JP-A No. 60-287487, JP-A No. 60-287488, JP-A No. 61-160287, JP-A No. 61-185483, JP-A No. 61-211079, JP-A No. 62-146678, JP-A No. 62-146680, JP-A No. 62-146679, JP-A No. 62-282885, JP-A No. 62-262047, JP-A No. 63-051174, JP-A No. 63-89877, JP-A No. 63-88380, JP-A No .63-113536, JP-A No. 63-163351, JP-A No. 63-203372, JP-A No. 63-224989, JP-A No. 63-251282, JP-A No. 63-267594, JP-A No. 63-182484, JP-A No. 01-239282, JP-A No. 02-262654, JP-A No. 02-71262, JP-A No. 03-121449, JP-A No. 04-291685, JP-A No. 04-291684, JP-A No. 05-61166, JP-A No. 05-119449, JP-A No. 05-188687, JP-A No. 05-188686, JP-A No. 05-110490, JP-A No. 05-1108437, JP-A No. 05-170361, JP-B No. 48-43295, JP-B No. 48-33212, U.S. Pat. No. 4,814,262, and U.S. Pat. No. 4,980,275.

Each of the other components can be used alone or in combination. These components can be solubilized in water, dispersed, polymer-dispersed, emulsified, or formed into oil droplets, or encapsulated in a microcapsules. The amount of the other components in the ink-jet recording medium of the present invention is preferably 0.01 to 10 g/m$^2$.

The coating composition for the ink receiving layer preferably comprises a surfactant. Any surfactant such as cationic, anionic, nonionic, amphoteric, fluorine-containing, and silicone surfactants can be used.

The nonionic surfactants include, but are not limited to, polyoxyalkylene alkyl ethers and polyoxyalkylene alkyl phenyl ethers such as diethylene glycol monoethyl ether, diethylene glycol diethyl ether, polyoxyethylene lauryl ether, polyoxyethylene stearyl ether, and polyoxyethylene nonyl phenyl ether; oxyethylene-oxypropylene block copolymers; sorbitan fatty acid esters such as sorbitan monolaurate, sorbitan monooleate, and sorbitan trioleate; polyoxyethylene sorbitan fatty acid esters such as polyoxyethylene sorbitan monolaurate, polyoxyethylene sorbitan monooleate, and polyoxyethylene sorbitan trioleate; polyoxyethylene sorbitol fatty acid esters such as polyoxyethylene sorbitol tetraoleate; glycerol fatty acid esters such as glycerol monooleate; polyoxyethylene glycerol fatty acid esters such as polyoxyethylene glycerol monostearate, and polyoxyethylene glycerol monooleate; polyoxyethylene fatty acid esters such as polyethylene glycol monolaurate, and polyethylene glycol monooleate; polyoxyethylene alkylamines; acetylene glycols such as 2,4,7,9-tetramethyl-5-decyne-4,7-diol, and ethylene oxide adducts and propylene oxide adducts of the diol. Among them, polyoxyalkylene alkyl ethers are preferred. These nonionic surfactants can be used in the coating composition A and/or the coating composition B. Each of these nonionic surfactants can be used alone or in combination.

The amphoteric surfactants include, but are not limited to, amino acid surfactants, carboxyammonium betaine surfactants, sulfone ammonium betaine surfactants, ammonium sulfate betaine surfactants, and imidazolium betaine surfactants. Examples of preferred amphoteric surfactants can be found in U.S. Pat. No. 3,843,368, JP-A No. 5949535, JP-A No. 63-236546, JP-A No. 05-303205, JP-A No. 08-262742, JP-A No. 10-282619, Japanese Patent (JP-B) No. 2514194, JP-B No. 2759795, and JP-A No. 2000-351269. Among these amphoteric surfactants, amino acid surfactants, carboxyammonium betaine surfactants, and sulfone ammonium betaine surfactants are preferred. Each of these amphoteric surfactants can be used alone or in combination.

The anionic surfactants include, but are not limited to, fatty acid salts such as sodium stearate and potassium oleate; salts of alkyl sulfates such as sodium lauryl sulfate, and triethanolamine lauryl sulfate; sulfonates such as sodium dodecylbenzenesulfonate; alkylsulfosuccinates such as sodium dioctylsulfosuccinate; alkyl diphenyl ether disulfonates, and salts of alkylphosphoric acids.

The cationic surfactants include, but are not limited to, alkylamine salts, quaternary ammonium salts, pyridinium salts, and imidazolium salts.

The fluorine-containing surfactants include, for example, compounds derived through intermediates each having a perfluoroalkyl group by, for example, electrolytic fluorination, telomerization, or oligomerization.

Examples of such compounds are perfluoroalkylsulfonates, perfluoroalkylcarboxylates, perfluoroalkyl ethylene oxide adducts, perfluoroalkyltrialkylammonium salts, perfluoroalkyl-containing oligomers, and perfluoroalkyl phosphates.

The silicone surfactants are preferably silicone oils each modified with an organic group. In such modified silicone oils, the siloxane structure is modified with an organic group at its side chain, at both of its ends, or at one of its ends. Such modified silicone oils include, for example, amino-modified, polyether-modified, epoxy-modified, carboxyl-modified, carbinol-modified, alkyl-modified, aralkyl-modified, phenol-modified, and fluorine-modified silicone oils.

The content of the surfactant in the coating composition for the ink receiving layer is preferably 0.001 to 2.0% by mass, and more preferably 0.01 to 1.0% by mass. If the ink receiving layer is formed by using two or more coating compositions, the surfactant is preferably added to each of these coating compositions.

The ink receiving layer preferably comprises a high boiling point organic solvent for inhibiting curling. Such high boiling point organic solvents are water-soluble or hydrophobic organic compounds having a boiling point of 150° C. or higher at normal atmospheric pressure. These compounds may be either a liquid or solid at room temperature and may have a low molecular weight or high molecular weight.

Examples of such organic compounds are aromatic carboxylic acid esters such as dibutyl phthalate, diphenyl phthalate, and phenyl benzoate; aliphatic carboxylic acid esters such as dioctyl adipate, dibutyl sebacate, methyl stearate, dibutyl maleate, dibutyl fumarate, and triethyl acetylcitrate; phosphoric esters such as trioctyl phosphate, and tricresyl phosphate; epoxides such as epoxidized soybean oil, and epoxidized fatty acid methyl esters; alcohols such as stearyl alcohol, ethylene glycol, propylene glycol, diethylene glycol, triethylene glycol, glycerol, diethylene glycol monobutyl ether (DEGMBE), triethylene glycol monobutyl ether, glycerol monomethyl ether, 1,2,3-butanetriol, 1,2,4-butanetriol, 1,2,4-pentanetriol, 1,2,6-hexanetriol, thiodiglycol, triethanolamine, and polyethylene glycol; vegetable oils such as soybean oil and sunflower oil; higher aliphatic carboxylic acids such as linolic acid, and oleic acid.

Supports

The support can be any of transparent supports made from plastics and other transparent materials, and opaque supports made from paper and other opaque materials. To sufficiently use the transparency of the ink receiving layer, a transparent support or a glossy opaque support is preferably used. In addition, read-only optical disks such as CD-ROM, DVD-ROM and the like, and rewritable optical disks such as CD-R, DVD-R and the like can also be used as the support, and an ink receiving layer is disposed on a label surface side of the disk.

Materials for use in the transparent support are preferably transparent and resistant to radiant heat when used in OHPs or backlight displays. Examples of such materials are poly (ethylene terephthalate)s (PETs) and other polyesters; polysulfones, poly(phenylene oxide)s, polyimides, polycarbonates, and polyamides. Among them, polyesters are preferred, of which poly(ethylene terephthalate)s are typically preferred.

The thickness of the transparent support is not specifically limited, can be appropriately set depending on an intended purpose and is preferably 50 μm to 200 μm for better handleability.

The glossy opaque support preferably has a glossiness on the surface on which the ink receiving layer is formed of 40% or more. The glossiness is determined according to the method specified in Japanese Industrial Standards P8142 (75 degree specular glossiness test method for paper and paper board). Examples of such supports are as follows.

Examples of the glossy opaque supports are art paper, coated paper, cast coated paper, baryta paper for use as supports for silver halide film photos, and other glossy paper supports; poly(ethylene terephthalate)s (PETs) and other polyesters, nitrocellulose, cellulose acetate, cellulose acetate butyrate, and other cellulose esters; glossy opaque films prepared from films of plastics such as polysulfones, poly (phenylene oxide)s, polyimides, polycarbonates, and polyamides by comprising, for example, a white pigment, these films may have been subjected to surface calendering; and supports prepared by forming a coat layer of a polyolefin which may contain a white pigment on the surface of the paper supports, transparent supports or glossy films containing, for example, a white pigment.

Preferred glossy opaque supports also include foamed polyester films containing a white pigment, such as a foamed PET containing fine polyolefin particles and having voids as a result of drawing, as well as resin coated paper for silver halide film photographic printing paper.

The thickness of the opaque support is not specifically limited, can be appropriately set depending on an intended purpose and is preferably 50 μm to 300 μm for better handleability.

To improve wetting properties and adhesion, the surface of the support may be subjected to, for example, corona discharge treatment, glow discharge treatment, flame treatment, or ultraviolet irradiation treatment, in advance.

Base paper for use in the resin coated paper will be described in detail below.

The base paper is made by using a wood pulp as a main material and further using, where necessary, a synthetic pulp such as a polypropylene pulp, or a synthetic fiber such as nylon or polyester fiber. The wood pulp can be any of LBKP, LBSP, NBKP, NBSP, LDP, NDP, LUKP, and NUKP. The base paper preferably comprises LBKP, NBSP, LBSP, NDP, and/or LDP having large proportions of short fibers in predominant amounts.

The content of at least one of the LBSP and LDP in the material is preferably 10% by mass to 70% by mass.

The pulp is preferably a chemical pulp containing less impurities, such as sulfate pulps and sulfite pulps. Pulps having improved whiteness as a result of bleaching are also useful.

The base paper may further comprise appropriate additives such as higher fatty acids; alkyl ketene dimers and other sizing agents; calcium carbonate, talc, titanium oxide, and other white pigments; starch, polyacrylamides, poly (vinyl alcohol)s, and other paper strengthening agents; fluorescent brightening agents; polyethylene glycols, and other humectants; dispersing agents; quaternary ammonium, and other softening agents.

The pulp for use in paper making preferably has a freeness in terms of Canadian Standard Freeness (CSF) of 200 ml to 500 ml. Regarding the fiber length after beating, the total of mass percentages of 24-mesh residue and that of 42-mesh residue as specified in JIS P8207 is preferably 30% by mass to 70% by mass. The content of 4-mesh residue is preferably 20% by mass or less.

The basis weight of the base paper is preferably 30 $g/m^2$ to 250 $g/m^2$, and more preferably 50 $g/m^2$ to 200 $g/m^2$. The thickness of the base paper is preferably 40 μm to 250 μm. The base paper can have high smoothness by calendering during or after paper-making. The density of the base paper is generally 0.7 $g/cm^3$ to 1.2 $g/cm^3$ as determined in accordance with JIS P8118.

The stiffness of the base paper is preferably 20 g to 200 g as determined under conditions specified in JIS P8143.

A surface sizing agent can be applied to the surface of the base paper. Such surface sizing agents include sizing agents that can be added to the base material.

The base paper preferably has pH of 5 to 9 as determined according to a hot water extraction method specified in JIS P8113.

The polyethylene layers covering the both sides of the base paper preferably mainly comprise at least one of a low density polyethylene (LDPE) and a high density polyethylene (HDPE). The polyethylene may further partially comprise a linear low density polyethylene (LLDPE), a polypropylene, and other components.

The polyethylene layer on the side on which the ink receiving layer is disposed preferably prepared by adding rutile- or anatase-type titanium oxide, a fluorescent brightening agent, and an ultramarine blue pigment to a material polyethylene to thereby improve opacity, whiteness, and hue as in photographic printing paper. The content of the titanium oxide is preferably 3% by mass to 20% by mass, and more preferably 4% by mass to 13% by mass relative to the polyethylene. The thickness of the two polyethylene layers is not specifically limited, can be appropriately set depending on an intended purpose and is preferably 10 μm to 50 μm, respectively. An undercoat layer can be disposed on the polyethylene layer so as to enable the polyethylene layer to adhere to the ink receiving layer more satisfactorily. The undercoat layer preferably comprises an aqueous polyester, gelatin, or a poly(vinyl alcohol) (PVA). The thickness of the undercoat layer is preferably 0.01 μm to 5 μm.

The polyethylene-coated paper can be used as glossy paper or paper having a matte surface or tweed surface prepared by embossing when the polyethylene is melted, extruded and applied onto the surface of the base paper, as in regular photographic printing paper.

The support may further have a back coating. The back coating can comprise a white pigment, an aqueous binder, and other components.

Such white pigments for use in the back coating include, but are not limited to, precipitated calcium carbonate light, calcium carbonate heavy, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudoboehmite, aluminum hydroxide, alumina, lithopone, zeolite, hydrated halloysite, magnesium carbonate, magnesium hydroxide, and other inorganic white pigments; styrenic plastic pigments, acrylic plastic pigments, polyethylenes, microcapsules, urea resins, melamine resins, and other organic white pigments.

Aqueous binders for use in the back coating include, but are not limited to, styrene-malate copolymers, styrene-acrylate copolymers, poly(vinyl alcohol)s, silanol-modified poly (vinyl alcohol)s, starch, cationized starch, casein, gelatin, carboxymethyl cellulose, hydroxyethyl cellulose, polyvinylpyrrolidones, and other water-soluble polymers; styrene-butadiene latices, acrylic emulsions, and other water-dispersible polymers.

Other components for use in the back coating include, but are not limited to, antifoaming agents, foam inhibitors, dyes, fluorescent brightening agents, antiseptics, and water-resistance improvers.

Production Methods for Ink-jet Recording Mediums

The ink receiving layer of the ink-jet recording medium of the present invention is preferably prepared, for example, by the following wet-on-wet method. Initially, a first coating composition (hereinafter referred to as "coating composition A") comprising at least the fine polymer particles and the water-soluble resin is applied to a surface of the support. A second coating composition comprising at least the mordant and having pH of 8 or higher (coating composition B) is applied to the coated layer (1) at the same time when the coating composition A is applied to thereby form a coated layer, or (2) at any time during drying procedure of the coated layer of the coating composition A and before the coated layer exhibits a falling rate of drying. The resulting coated layer is then crosslinked and cured. The fine polymer particles according to the present invention are preferably contained in at least one of the coating composition A and the coating composition B. Likewise, the crosslinking agent that is capable of crosslinking the water-soluble resin is preferably contained in at least one of the coating composition A and the coating composition B.

The resulting ink receiving layer crosslinked and cured in this manner can more satisfactorily absorb inks and can prevent cracking. When prepared in the above manner, most of the mordant is present in the vicinity of the surface of the ink receiving layer, and the ink can thereby be mordanted sufficiently to thereby improve water resistance of characters and images after printing. A part of the mordant can be contained in the coating composition A. In this case, the mordants in the coating composition A and the coating composition B may be the same with or different from each other.

The coating composition for the ink receiving layer (coating composition A) can be applied according to a conventional coating process such as extrusion die coating, air doctor coating, blade coating, rod coating, knife coating, squeeze coating, reverse roll coating, or bar coating.

The coating composition B is applied to a coated layer of the coating composition for the ink receiving layer (coating composition A) on or after the application thereof. It can be applied before the coated layer exhibits a falling rate of drying. Specifically, the ink receiving layer should preferably be produced by introducing the mordant after the application of the coating composition for the ink receiving layer (coating composition A) and before the coated layer exhibits a falling rate of drying.

The phrase "before the coated layer exhibits a falling rate of drying" as used herein means a period between immediately after the application of the coating composition for the ink receiving layer (coating composition A) and several minutes later. During this period, the coated layer exhibits a "constant rate of drying", in which the content of the solvent (dispersion medium) in the coated layer decreases in proportion of the time. The constant-rate period of drying is described in, for example, Handbook of Chemical Engineering, pp. 707–712, Oct. 25, 1975, Maruzen Co., Ltd. Tokyo Japan.

The coated layer of the first coating composition (coating composition A) is dried until the coated layer exhibits a decreasing rate of drying. The drying procedure is generally performed at 50° C. to 180° C. for 0.5 minutes to 10 minutes, preferably for 0.5 minutes to 5 minutes. The aforementioned drying time is generally appropriate, while the drying time varies depending on the coated amount.

The coating composition B is coated onto the first coated layer before the first coated layer exhibits a decreasing rate of drying, for example, (1) by applying the coating composition B further onto the first coated layer, (2) by spraying the coating composition B onto the first coated layer, or (3) by dipping the support carrying the first coated layer in the coating composition B.

In the process (1), the coating composition B can be applied according to a conventional coating procedure such as curtain flow coating, extrusion die coating, air doctor coating, blade coating, rod coating, knife coating, squeeze coating, reverse roll coating, or bar coating. Among such procedures, extrusion die coating, curtain flow coating, bar coating, and other coating procedures, in which a coater does not directly come into contact with the formed first coated layer, are preferred.

After the application of the mordant composition (coating composition B), the resulting layer is generally dried and cured at 40° C. to 180° C. for 0.5 minutes to 30 minutes, preferably at 40° C. to 150° C. for 1 minute to 20 minutes.

To apply the mordant composition (coating composition B) at the same time with the application of the coating composition for the ink receiving layer (coating composition A), the coating composition for the ink receiving layer (coating composition A) and the mordant composition (coating composition B) are applied to the support concurrently (multilayer coating) so that the coating composition for the ink receiving layer (coating composition A) comes into contact with the support. The resulting layer is then dried and cured and thereby yields the ink receiving layer.

The concurrent coating (multilayer coating) can be performed, for example, according to a coating procedure using an extrusion die coater or a curtain flow coater. After the concurrent coating, the resulting layer is generally preferably dried at 40° C. to 150° C. for 0.5 minutes to 10 minutes, and more preferably at 40° C. to 100° C. for 0.5 minutes to 5 minutes.

For example, when the current coating (multilayer coating) is performed using an extrusion die coater, the two coating compositions are discharged concurrently and constitute a multilayer in the vicinity of a discharge port of the extrusion die coater before they move to the support, and the multilayer in this state is applied onto the support. The two-layer coating compositions constituting the multilayer before application may easily invite a crosslinking reaction at the interface between the two compositions during movement to the support. In some cases, the discharged two compositions may be mixed and become viscous in the vicinity of the discharge port of the extrusion die coater, thus preventing the coating operation. To avoid this problem, it is preferred that a barrier layer composition (intermediate layer composition) is interposed between the coating composition for the ink receiving layer (coating composition A) and the mordant composition (coating composition B), and these three layers are applied concurrently onto the support to form triple layers.

The barrier layer composition is not specifically limited, can be appropriately selected depending on an intended purpose and includes, for example, water and aqueous solutions containing a water-soluble resin. The water-soluble resin is used, for example, as a thickening agent to improve coatability. Such water-soluble resins include, but are not limited to, cellulosic resins such as hydroxypropylmethylcellulose, methylcellulose, and hydroxyethylmethylcellulose; polyvinylpyrrolidones; gelatin; and other polymers. The barrier layer composition may further comprise the mordant.

The ink receiving layer formed on the support can be subjected to calendering, for example, by allowing the ink receiving layer to pass between roll nips while heating under pressure using a super calendar or a gloss calendar to thereby improve its surface smoothness, glossiness, transparency, and film strength. However, the calendering may decrease the porosity and should be performed under conditions so as to minimize decrease of the porosity. If the porosity decreases, the resulting medium may not absorb inks satisfactorily.

The roll temperature in the calendering is preferably 30° C. to 150° C., and more preferably 40° C. to 100° C.

The linear pressure between rolls in the calendering is preferably 50 kgf/cm$^2$ to 400 kgf/cm$^2$, and more preferably 100 kgf/cm$^2$ to 200 kgf/cm$^2$.

The dry thickness of the ink receiving layer must be set in consideration of the porosity in the layer, since the layer must absorb all the droplets when the medium is used in ink-jet recording. For example, when the amount of ink is 8 nL/mm$^2$ and the porosity is 60%, the dry thickness of the ink receiving layer must be about 15 μm or more.

In consideration of this, the dry thickness of the ink receiving layer is preferably 10 μm to 100 μm in ink-jet recording.

The ink receiving layer preferably has high transparency and has a haze of preferably 30% or less, and more preferably 20% or less as determined when the ink receiving layer is formed on a transparent film support.

The haze can be determined by using a haze meter (HGM-2DP, available from Suga Test Instruments, Tokyo, Japan).

The ink-jet recording medium can also be produced by any of methods described in JP-A No. 10-81064, JP-A No. 10-119423, JP-A No. 10-157277, JP-A No. 10-217601, JP-A No. 11-348409, JP-A No. 2001-138621, JP-A No. 2000-43401, JP-A No. 2000-211235, JP-A No. 2000-309157, JP-A No. 2001-96897, JP-A No. 2001-138627, JP-A No. 11-91242, JP-A No. 08-2087, JP-A No. 08-2090, JP-A No. 08-2091, and JP-A No. 08-2093.

Inks

The ink for use in the ink-jet recording medium of the present invention is not specifically limited and can be at least any of conventional water-based inks and oil-based inks.

The ink to be contained in the ink can be at least any of conventional dyes, pigments, and other coloring agents, as well as materials capable of developing color. For example, as dyes for use in ink-jet recording, direct dyes, acidic dyes, basis dyes, reactive dyes, food dyes, and other water-soluble dyes are preferred. The pigments include, but are not limited to, carbon blacks, pigment yellow, pigment red, and pigment blue. Inks comprising a pigment are preferably used in some applications, for higher image density and higher resistance to fading.

Image Forming Methods

In the image forming method according to the present invention, an ink is applied to the ink receiving layer of the ink-jet recording medium of the present invention to thereby form an image.

The process for applying an ink to the ink receiving layer of the ink-jet recording medium to thereby form an image as a record is not specifically limited, can be appropriately selected depending on an intended purpose and is preferably an ink-jet recording process. The ink-jet recording process can be any process that can effectively release the ink from nozzles and can apply the ink to a recording medium. A preferred example of such an ink-jet recording process can be found in JP-A No. 54-59936. In this process, an ink is affected by heat energy and rapidly changes its volume to yield force, and the ink is discharged from a nozzle by action of the force.

The ink-jet head to be used in the ink-jet recording process may be either an on-demand type or a continuous type. Any discharge process may be used, such as an electromechanical conversion process such as a single cavity type, a double cavity type, a bender type, a piston type, a share mode type and a shared wall type, an electro-thermal conversion process such as a thermal ink-jet type and a bubble-jet (registered trademark) type, a static attraction process such as an electric field control type and a slit jet type, and a discharge method such as a spark jet type.

The image forming method of the present invention can print high-quality images equivalent to silver halide film photos at a high speed, which images exhibit high absorbency of inks, high print density, minimized bleeding with time, and satisfactory light resistance.

The present invention will be illustrated in further detail with reference to several examples below, which are not intended to limit the scope of the present invention.

PREPARATION EXAMPLE 1

A mixture of 160 parts by mass of ion-exchanged water, 0.6 part by mass of sodium dodecylsulfate, 27 parts by mass of methyl methacrylate, and 3 parts by mass of divinylbenzene is heated to 70° C. while stirring under flow of nitrogen gas. The resulting mixture was further treated with an initiator solution of 0.40 part by mass of potassium peroxydisulfate in 10 parts by mass of ion-exchanged water with stirring at 70° C. under flow of nitrogen gas for 2 hours and thereby yielded a 15.0% by mass suspension of fine polymer particles according to Preparation Example 1. The fine polymer particles had an average particle diameter of 49 nm.

PREPARATION EXAMPLE 2

A 15.0% by mass suspension of fine polymer particles according to Preparation Example 2 was prepared by the procedure of Preparation Example 1, except that the amount of sodium dodecylsulfate was changed from 0.6 parts by mass to 1.5 parts by mass. The resulting fine polymer particles according to Preparation Example 2 had an average particle diameter of 30 nm.

PREPARATION EXAMPLE 3

A 15.0% by mass suspension of fine polymer particles according to Preparation Example 3 was prepared by the procedure of Preparation Example 1, except that ethylene glycol dimethacrylate was used instead of divinylbenzene. The resulting fine polymer particles according to Preparation Example 3 had an average particle diameter of 39 nm.

PREPARATION EXAMPLE 4

A 15.0% by mass suspension of fine polymer particles according to Preparation Example 4 was prepared by the procedure of Preparation Example 1, except that 0.6 part by mass of cetyltrimethylammonium bromide was used instead of 0.6 part by mass of sodium dodecylsulfate, and that 0.4 part by mass of 2,2'-azobis(2-amidinopropane) dihydrochloride was used instead of 0.4 part by mass of potassium peroxydisulfate. The resulting fine polymer particles according to Preparation Example 4 had an average particle diameter of 49 nm.

PREPARATION EXAMPLE 5

A 15.0% by mass suspension of fine polymer particles according to Preparation Example 5 was prepared by the procedure of Preparation Example 1, except that 1.5 parts by mass of a cationic polymer (1) represented by the following formula was used instead of 0.6 parts by mass of sodium dodecylsulfate. The resulting fine polymer particles according to Preparation Example 5 had an average particle diameter of 75 nm.

Cationic Polymer (1)

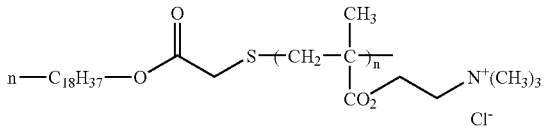

average molecular weight: 4000

Preparation of Support

A wood pulp comprising 100 parts by mass of LBKP was beaten in a double disk refiner to a Canadian Standard Freeness (CSF) of 300 ml. To the beaten pulp were added 0.5 part by mass of epoxidized behenamide, 1.0 part by mass of an anionic polyacrylamide, 0.1 part by mass of a polyamide polyamine epichlorohydrin, and 0.5 part by mass of a cationic polyacrylamide in absolute dry masses to the pulp, and the mixture was made into a base paper having a basis weight of 170 g/m$^2$ using a wire paper machine.

The surface size of the above-prepared base paper was then adjusted in the following manner. To a 4% by mass aqueous solution of a poly(vinyl alcohol) was added 0.04% by mass of a fluorescent brightening agent ("Whitex BB" available from Sumitomo Chemical Co., Ltd., Osaka, Japan). The base paper was impregnated with the mixture in an amount of 0.5 g/m$^2$ in terms of absolute dry mass, was dried, was subjected to calendering and thereby yielded a base paper having a density of 1.05 g/cm$^3$.

After subjecting the wire side (back side) of the base paper to corona discharge treatment, a high density polyethylene (HDPE) was extruded and applied to the treated back side to a thickness of 19 μm using a melt-extruder and thereby yielded a matte resin layer (this resin layer side is hereinafter referred to as "back side"). The resin layer on the back side was subjected to corona discharge treatment. An aqueous dispersion was applied to the treated resin layer to a dry mass of 0.2 g/m$^2$, which aqueous dispersion contained aluminum oxide ("Alumina Sol 100" available from Nissan Chemical Industries, Ltd., Japan) and silicon dioxide ("Snow Tex O" available from Nissan Chemical Industries, Ltd., Japan) as antistatic agents in a mass ratio of 1:2 in water.

The felt side (front side) of the base paper on which the resin layer was not formed was subjected to corona discharge treatment. A low density polyethylene (LDPE) was extruded and applied to the treated front side by using a melt-extruder to a thickness of 29 μm and thereby yielded a highly glossy thermoplastic resin layer on the front side of the base paper (this highly glossy surface is hereinafter referred to as "front side") and thereby yielded a support. The LDPE contained 10% by mass of an anatase-type titanium oxide, a trace amount of ultramarine blue, and 0.01% by mass of a fluorescent brightening agent relative to mass of the LDPE and had a melt flow rate (MFR) of 3.8.

EXAMPLE 1

Preparation of Coating Composition A for Ink-receiving Layer

To 10.0 parts by weight of the fine polymer particles suspension according to Preparation Example 1 were added 0.14 part by mass of a polyoxyethylene lauryl ether ("EMULGEN 109P" available from Kao Corporation, Japan; a 10% by mass aqueous solution, HLB: 13.6), 2.40 parts by mass of a 7% by mass aqueous solution of a poly(vinyl alcohol) ("PVA 420", available from Kuraray Co., Ltd., Japan; degree of saponification: 78%, degree of polymerization: 2000), and 7.76 parts by mass of ion-exchanged water with stirring and thereby yielded a coating composition A for an ink receiving layer.

Production of Ink-jet Recording Medium

The front side of the above-prepared support was subjected to corona discharge treatment. The coating composition A for an ink receiving layer was applied to the treated front side of the support to an amount of 180 ml/m$^2$ using an extrusion die coater, and the coated layer was dried at 80° C. at an airspeed of 3 to 8 m/sec. using a hot-air dryer to a solid content of the coated layer of 20% by mole. During this drying period, the coated layer exhibited a constant rate of drying.

Immediately after the drying operation, the coated layer was immersed in a coating composition B for 30 seconds to a dry mass of 20 g/m$^2$, and the layer was dried at 80° C. for 10 minutes. The coating composition B contained 6.6 parts by mass of boric acid as a crosslinking agent, 66 parts by mass of a 10% by mass aqueous solution of a polyallylamine "PAA-10C" (trade name, available from Nitto Boseki Co., Ltd., Japan) as a mordant, 2.6 parts by mass of ammonium chloride, 26.4 parts by mass of a polyoxyethylene lauryl ether ("EMULGEN 109P" available from Kao Corporation, Japan; a 2% by mass aqueous solution, HLB: 13.6), 5.3 parts by mass of a 10% by mass aqueous solution of a fluorine-containing surfactant ("Megafac F1405", available from Dainippon Ink & Chemicals, Inc., Japan), and 157 parts by mass of ion-exchanged water.

Thus, an ink-jet recording medium according to Example 1 having an ink receiving layer with a dry thickness of 39 μm was produced.

EXAMPLE 2

Production of Ink-jet Recording Medium

An ink-jet recording medium according to Example 2 was produced by the procedure of Example 1, except that the fine polymer particles suspension according to Preparation Example 2 was used instead of the fine polymer particles suspension according to Preparation Example 1 in the coating composition A for an ink receiving layer.

EXAMPLE 3

Production of Ink-jet Recording Medium

An ink-jet recording medium according to Example 3 was produced by the procedure of Example 1, except that the fine polymer particles suspension according to Preparation Example 3 was used instead of the fine polymer particles suspension according to Preparation Example 1 in the coating composition A for an ink receiving layer.

EXAMPLE 4

Production of Ink-jet Recording Medium

An ink-jet recording medium according to Example 4 was produced by the procedure of Example 1, except that the fine polymer particles suspension according to Preparation Example 4 was used instead of the fine polymer particles suspension according to Preparation Example 1 in the coating composition A for an ink receiving layer.

EXAMPLE 5

Production of Ink-jet Recording Medium

An ink-jet recording medium according to Example 5 was produced by the procedure of Example 1, except that the fine polymer particles suspension according to Preparation Example 5 was used instead of the fine polymer particles suspension according to Preparation Example 1 in the coating composition A for an ink receiving layer.

EXAMPLE 6

Production of Ink-jet Recording Medium

An ink-jet recording medium according to Example 6 was produced by the procedure of Example 1, except that "PVA 235" (available from Kuraray Co., Ltd., Japan; degree of saponification: 88%, degree of polymerization: 3500) was used as the poly(vinyl alcohol) in the poly(vinyl alcohol) in the coating composition A for an ink receiving layer.

EXAMPLE 7

Production of Ink-jet Recording Medium

An ink-jet recording medium according to Example 7 was produced by the procedure of Example 1, except that the amount of the 7% by mass aqueous solution of the poly (vinyl alcohol) in the coating composition A for an ink receiving layer was changed from 2.40 parts by mass to 1.20 parts by mass.

EXAMPLE 8

Production of Ink-jet Recording Medium

An ink-jet recording medium according to Example 8 was produced by the procedure of Example 1, except that a polyallylamine "PAA-03" (available from Nitto Boseki Co., Ltd., Japan) was used instead of the polyallylamine "PAA-10C" in the coating composition B.

EXAMPLE 9

Production of Ink-jet Recording Medium

An ink-jet recording medium according to Example 9 was produced by the procedure of Example 1, except that the polyallylamine "PAA-10C" was not used in the coating composition B.

EXAMPLE 10

Production of Ink-jet Recording Medium

An ink-jet recording medium according to Example 10 was produced by the procedure of Example 1, except that "PVA 220" (available from Kuraray Co., Ltd., Japan; degree of saponification: 88, degree of polymerization: 2000) was used as the poly(vinyl alcohol) in the poly(vinyl alcohol) in the coating composition A for an ink receiving layer.

COMPARATIVE EXAMPLE 1

Production of Ink-jet Recording Medium

An ink-jet recording medium according to Comparative Example 1 was produced by the procedure of Example 1, except that "PVA 124" (available from Kuraray Co., Ltd., Japan) was used as the poly(vinyl alcohol) in the poly(vinyl alcohol) in the coating composition A for the ink receiving layer.

COMPARATIVE EXAMPLE 2

Production of Ink-jet Recording Medium

An ink-jet recording medium according to Comparative Example 2 was produced by the procedure of Example 1, except that "PVA 180" (available from Kuraray Co., Ltd., Japan; degree of saponification: 98.5%, degree of polymerization: 8000) was used as the poly(vinyl alcohol) in the poly(vinyl alcohol) in the coating composition A for an ink receiving layer.

COMPARATIVE EXAMPLE 3

Production of Ink-jet Recording Medium

An ink-jet recording medium according to Comparative Example 3 was produced by the procedure of Example 1, except that the boric acid was not used in the coating composition B.

COMPARATIVE EXAMPLE 4

Production of Ink-jet Recording Medium

An ink-jet recording medium according to Comparative Example 4 was produced by the procedure of Example 1, except that the coated layer of the coating composition A for an ink receiving layer was not immersed in the coating composition B and was dried at 80° C. at an air speed of 3 to 8 m/sec for 10 minutes with a hot air dryer.

COMPARATIVE EXAMPLE 5

Production of Ink-jet Recording Medium

An ink-jet recording medium according to Comparative Example 5 was produced by the procedure of Comparative Example 1, except that a silica suspension was used instead of the fine polymer particles suspension according to Preparation Example 1 in the coating composition A for an ink receiving layer. The silica suspension was prepared by mixing 1.5 parts by mass of fine silica particles produced by a gas phase method ("Reolosil QS-30", available from TOKUYAMA Corporation, Japan; average primary particle diameter: 7 nm), 8.4 parts by mass of ion-exchanged water, and 0.125 part by mass of a dispersing agent ("PAS-M-S" available from Nitto Boseki Co., Ltd., Japan; a 60% by mass aqueous solution), and dispersing the components at the number of revolutions of 10000 rpm for 20 minutes using a dispersing device "KD-P" (available from Shinmaru Enterprises Corporation, Japan).

Pore Distribution Curves

The pore distribution curves in adsorption of the ink receiving layers of the ink-jet recording mediums according to Examples 1 to 10 and Comparative Examples 1 to 5 were determined. The results are shown in Table 1.

Measuring Device and Measuring Conditions

Method: nitrogen gas adsorption technique

Device: accelerated surface area and porosimetry analyzer ASAP-2400 available from Micromeritics Instrument Corporation, GA, USA)

Analyzing method: BJH method

TABLE 1

| | Particle diameter of fine polymer particles: X (nm) | Peak top in gas adsorption*1: Y (nm) | (Y/X) × 100 (%) | A*2 (× $10^{-5}$ ml/cm$^2$) | Thickness: B (μm) | A/B (× $10^{-5}$ ml/cm$^2$/μm) |
|---|---|---|---|---|---|---|
| Ex. 1 | 49 | 36 | 73 | 140 | 39 | 3.6 |
| Ex. 2 | 30 | 35 | 117 | 130 | 37 | 3.5 |
| Ex. 3 | 39 | 37 | 95 | 140 | 39 | 3.6 |
| Ex. 4 | 49 | 40 | 82 | 150 | 40 | 3.8 |
| Ex. 5 | 75 | 55 | 73 | 180 | 44 | 4.1 |
| Ex. 6 | 49 | 36 | 73 | 130 | 34 | 3.8 |
| Ex. 7 | 49 | 38 | 78 | 160 | 39 | 4.1 |
| Ex. 8 | 49 | 36 | 73 | 150 | 39 | 3.8 |
| Ex. 9 | 49 | 47 | 96 | 190 | 47 | 4.0 |
| Ex. 10 | 49 | 35 | 140 | 130 | 38 | 3.4 |
| Com. Ex. 1 | 49 | 30 | 61 | 40 | 26 | 1.5 |
| Com. Ex. 2 | 49 | 33 | 61 | 48 | 30 | 1.6 |
| Com. Ex. 3 | 49 | 24 | 49 | 40 | 36 | 1.1 |
| Com. Ex. 4 | 49 | 22 | 45 | 38 | 35 | 1.1 |
| Com. Ex. 5 | 7 | — | — | — | 35 | — |

*1: Pore diameter Y (nm) in the ink receiving layer corresponding to the maximum peak of the pore distribution curve in adsorption which is measured by the nitrogen gas adsorption technique and determined by calculation according to the BJH method

*2: Pore Volume A (× $10^{-5}$ ml/cm$^2$) in the ink receiving layer at a pore diameter equal to the average particle diameter of the fine polymer particles Evaluation Tests The ink absorbency, print density, bleeding with time, and light resistance of the ink-jet recording mediums according to Examples 1 to 10 and Comparative Examples 1 to 5 were determined by the following methods. The results are shown in Table 2.

Ink Absorbency

Using an ink-jet printer ("PM-900C" available from Seiko Epson Corporation, Japan), Y (yellow), M (magenta), C (cyan), K (black), B (blue), G (green), and R (red) solid images were printed on a sample ink-jet recording medium. Immediately after printing (about 10 seconds later), paper was pressed onto the images, and whether or not the ink was transferred to the paper was visually observed. The ink absorbency was rated according to the following criteria. In this connection, when the ink was not transferred onto the paper, the medium absorbed the ink at a satisfactory speed.

Criteria

AA: The ink was not transferred onto the paper.

BB: A part of the ink was transferred onto the paper.

CC: A large part of the ink was transferred onto the paper.

Print Density

Using an ink-jet printer ("PM-900C" available from Seiko Epson Corporation, Japan), a K (black) solid image was printed onto a sample ink-jet recording medium. The printed medium was then left stand for 3 hours, and the reflection density of the printed surface was measured with a Macbeth reflection densitometer. The print density was rated according to the following criteria.

Criteria

AA: The reflection density was 2.0 or higher.

BB: The reflection density was 1.8 or more and less than 2.0.

CC: The reflection density was less than 1.8.

Bleeding with Time

Using an ink-jet printer ("PM-900C" available from Seiko Epson Corporation, Japan), a grid linear pattern (line width: 0.28 mm) comprising a magenta ink and a black ink alternately arranged was printed on a sample ink-jet recording medium. The visual density (ODfresh) of the printed image was determined with an XLight 310 TR (available from XLight Photonics, Israel). After the determination, the printed ink-jet recording medium was placed in a Clear File and was stored in a thermo-hygrostat at 35° C. at a relative humidity 80% for three days. The visual density (ODthermo) of the stored medium was determined, and the rate of density-change [(ODthermo)/(ODfresh)×100] was calculated. The bleeding with time was rated based on the rate of density-change according to the following criteria. A less rate of density-change means less bleeding with time.

Criteria

AA: The rate of density-change was less than 140%.

BB: The rate of density-change was 140% or more and less than 160%.

CC: The rate of density-change was 160% or more.

Light Resistance

Using an ink-jet printer ("PM-900C" available from Seiko Epson Corporation, Japan), magenta and cyan solid images were printed on a sample ink-jet recording medium. The printed medium was then irradiated with a lamp in a Xenon Weather-o-meter Ci65A (available from ATLAS ELECTRIC DEVICES, COMPANY, IL, USA) through a filter that cuts ultraviolet rays with wavelengths of 365 nm or lower at a temperature of 25° C. and at a relative humidity of 32% for 3.8 hours. The medium was then left stand without the irradiation of light at a temperature of 20° C. and at a relative humidity of 91% for 1 hour. This cycle was repeated for a total of 168 hours. The image densities of each color before and after the test were determined with a Macbeth reflection densitometer. The residual rate of each color was determined by calculation, and the light resistance was rated according to the following criteria.

Criteria

AA: The residual rate was 80% or more.

BB: The residual rate was 70% or more and less than 80%.

CC: The residual rate was less than 70%.

TABLE 2

| | Ink absorbency | Print density | Bleeding with time | Light resistance |
|---|---|---|---|---|
| Ex. 1 | AA | AA | AA | AA |
| Ex. 2 | AA | AA | AA | AA |
| Ex. 3 | AA | AA | AA | AA |
| Ex. 4 | AA | AA | AA | AA |
| Ex. 5 | AA | AA | AA | AA |
| Ex. 6 | AA | AA | AA | AA |
| Ex. 7 | AA | AA | AA | AA |
| Ex. 8 | AA | AA | AA | AA |
| Ex. 9 | AA | AA | BB | AA |
| Ex. 10 | AA | AA | AA | AA |
| Com. Ex. 1 | CC | | not ratable*3 | |
| Com. Ex. 2 | CC | | not ratable*3 | |
| Com. Ex. 3 | CC | | not ratable*3 | |
| Com. Ex. 4 | CC | | not ratable*3 | |
| Com. Ex. 5 | AA | AA | BB | BB |

*3: The tested medium could not absorb the ink completely, and image bleeding occurred, thus preventing the rating.

Table 2 shows that the ink-jet recording mediums according to Examples 1 to 10 can absorb inks satisfactorily and exhibit satisfactory print density, minimized bleeding with time, and excellent light resistance.

In contrast, the ink-jet recording mediums according to Comparative Examples 1 to 4 absorb inks markedly insufficiently, thus inviting bleeding of images. The ink-jet recording medium according to Comparative Example 5 using the conventional silica particles exhibits lower light resistance than the ink-jet recording mediums according to Examples 1 to 10, although it satisfactorily absorbs inks and exhibits good print density.

The present invention can solve the problems in conventional technologies and can provide ink-jet recording mediums which have an ink receiving layer having a porous structure optimized by fine polymer particles (latex), can satisfactorily absorb inks and exhibit high print density, minimized bleeding with time, and satisfactory light resistance.

What is claimed is:

1. An ink-jet recording medium comprising:

a support; and an ink receiving layer disposed on the support, the ink receiving layer containing at least fine polymer particles and having a porous structure, wherein secondary particles of the fine polymer particles constitute the porous structure of the ink receiving layer, wherein the fine polymer particles are selected from the group consisting of homo- or co-polymers of vinyl monomers, ester polymers, urethane polymers, amide polymers, epoxy polymers, and modified products and copolymers of these polymers, and the content of the fine polymer particles is 50% by mass or more of solid contents in the ink receiving layer, and wherein the ink receiving layer has a pore volume per unit thickness (A/B) of $2.0\times10^{-5}$ml/cm$^2$/μm or more, wherein A is a pore volume ($\times10^{-5}$ ml/cm$^2$) in the ink receiving layer at a pore diameter equal to an average particle diameter of the fine polymer particles, the pore volume being determined based on a pore distribution curve obtained according to a nitrogen gas adsorption technique; and B is a dry thickness (μm) of the ink receiving layer.

2. An ink-jet recording medium according to claim 1, wherein the pore volume A in the ink receiving layer at the pore diameter equal to the average particle diameter of the fine polymer particles is $50\times10^{-5}$ ml/cm$^2$ or more.

3. An ink-jet recording medium according to claim 1, wherein a ratio of Y to X [(Y/X)×100] is 65% or more, wherein Y is a pore diameter (nm) at a maximum peak of the pore volumes in the ink receiving layer, the pore diameter being determined based on a pore distribution curve obtained according to a nitrogen gas adsorption technique; and X is an average particle diameter (nm) of the fine polymer particles.

4. An ink-jet recording medium according to claim 1, wherein the pore diameter Y is 33 nm or more, where Y is the pore diameter corresponding to a maximum peak of a pore volumes of secondary particles of the fine polymer particles in the ink receiving layer, the pore diameter being determined based on a pore distribution curve obtained according to a nitrogen gas adsorption technique.

5. An ink-jet recording medium according to claim 1, wherein the fine polymer particles have an average particle diameter of 10 to 100 nm.

6. An ink-jet recording medium according to claim 1, wherein the ink receiving layer further contains a water-soluble resin.

7. An ink-jet recording medium according to claim 6, wherein the water-soluble resin is at least one of poly(vinyl alcohol) resins, cellulosic resins, resins having an ether bond, resins having a carbamoyl group, resins having a carboxyl group, and gelatin substances.

8. An ink-jet recording medium according to claim 7, wherein the poly(vinyl alcohol) resins are partially saponified poly(vinyl alcohol)s.

9. An ink-jet recording medium according to claim 8, wherein the partially saponified poly(vinyl alcohol)s have a degree of saponification of 65% to 90%.

10. An ink-jet recording medium according to claim 6, wherein a mass ratio of the fine polymer particles to the water-soluble resin in the ink receiving layer is from 4:1 to 20:1.

11. An ink-jet recording medium according to claim 6, wherein a content of the water-soluble resin is 4% to 25% by mass of total solids in the ink receiving layer.

12. An ink-jet recording medium according to claim 1, wherein the ink receiving layer further contains a crosslinking agent.

13. An ink-jet recording medium according to claim 12, wherein the ink-receiving layer further comprises a water-soluble resin, and the water-soluble resin is crosslinked using the crosslinking agent.

14. An ink-jet recording medium according to claim 1, wherein the ink receiving layer further contains a mordant.

15. An ink-jet recording medium according to claim 1, wherein the ink receiving layer has a dry thickness of 10 to 100 μm.

16. An ink-jet recording medium according to claim 1, wherein the fine polymer particles are homo- or co-polymers of vinyl monomers or urethane polymers.

17. An ink-jet recording medium according to claim 1, wherein the ink-jet receiving layer further contains a boron compound.

18. An image forming method comprising the step of:

applying an ink to an ink receiving layer of an ink-jet recording medium so as to form an image, wherein the ink-jet recording medium comprises:

a support; and the ink receiving layer disposed on the support, the ink receiving layer containing at least fine polymer particles and having a porous structure, wherein secondary particles of the fine polymer particles constitute the porous structure of the ink receiving layer, wherein the fine polymer particles are selected from the group consisting of homo- or co-polymers of vinyl monomers, ester polymers, urethane polymers, amide polymers, epoxy polymers, and modified products and copolymers of these polymers, and the content of the fine polymer particles is 50% by mass or more of solid contents in the ink receiving layer, and wherein the ink receiving layer has a pore volume per unit thickness (A/B) of $2.0\times10^{31\ 5}$ ml/cm$^2$μm or more, wherein A is a pore volume (×10 ml/cm$^2$) of the ink receiving layer at a pore diameter equal to the average particle diameter of the fine polymer particles, the pore volume being determined based on a pore distribution curve obtained according to a nitrogen gas adsorption technique; and B is a dry thickness (μm) of the ink receiving layer.

19. An image forming method according to claim 16, wherein a ratio of Y to X [(Y/X)×100] in the ink-jet recording medium is 65% or more, wherein Y is a pore diameter (nm) at a maximum peak of the pore volumes in the ink receiving layer, the pore diameter being determined based on a pore distribution curve obtained according to a nitrogen gas adsorption technique; and X is an average particle diameter (nm) of the fine polymer particles.

20. An image forming method according to claim 16, wherein the pore diameter Y in the ink-jet recording medium is 33 nm or more, where Y is the pore diameter corresponding to a maximum peak of a pore volume of secondary particles of the fine polymer particles in the ink receiving layer, the pore diameter being determined based on a pore distribution curve obtained according to a nitrogen gas adsorption technique.

* * * * *